US005712230A

United States Patent [19]

Abraham et al.

[11] Patent Number: 5,712,230

[45] Date of Patent: Jan. 27, 1998

[54] ADDITIVE COMPOSITIONS HAVING REDUCED SULFUR CONTENTS FOR LUBRICANTS AND FUNCTIONAL FLUIDS

[75] Inventors: William D. Abraham, South Euclid; John S. Manka, Euclid; Stephen H. Roby, Chesterland; James A. Supp, Parma, all of Ohio

[73] Assignee: The Lubrizol Corporation, Wickliffe, Ohio

[21] Appl. No.: 812,897

[22] Filed: Mar. 10, 1997

[51] Int. Cl.[6] ..... C10M 141/10

[52] U.S. Cl. ..... 508/232; 508/377; 508/424; 508/322; 508/375; 508/441; 508/443; 508/444

[58] Field of Search ..... 508/232, 377, 508/424, 322, 375, 441, 443, 444

[56] References Cited

U.S. PATENT DOCUMENTS

| | | | |
|---|---|---|---|
| 2,599,761 | 6/1952 | Harman et al. | 508/424 |
| 4,263,150 | 4/1981 | Clason et al. | 508/377 |

*Primary Examiner*—Jacqueline V. Howard
*Attorney, Agent, or Firm*—William J. Connors

[57] ABSTRACT

This invention relates to a composition, comprising: (AT) reaction products of compounds represented by the formula (A)and compounds selected to reduce the polysulfide components of (A); and

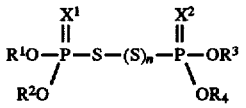

(A)

wherein in Formula (A), $R^1$, $R^2$, $R^3$ and $R^4$ are independently hydrocarbyl groups, $X^1$ and $X^2$ are independently O or S, and n is zero to 3 (B) an acylated nitrogen-containing compound having a substituent of at least 10 aliphatic carbon atoms. In one embodiment, the inventive composition further comprises (C) a second phosphorus compound other than (A), said second phosphorus compound being a phosphorus acid, phosphorus acid ester, phosphorus acid salt, or derivative thereof. In one embodiment, the inventive composition further comprises (D) an alkali or alkaline earth metal salt of an organic sulfur acid, carboxylic acid or phenol. In one embodiment, the inventive composition further comprises (E) a thiocarbamate In one embodiment the inventive composition further comprises (F), a non-phosphorous organodisulfide. These compositions are useful in providing lubricating compositions and functional fluids with enhanced antiwear properties.

47 Claims, No Drawings

ADDITIVE COMPOSITIONS HAVING REDUCED SULFUR CONTENTS FOR LUBRICANTS AND FUNCTIONAL FLUIDS

TECHNICAL FIELD

This invention relates to composition having reduced sulfur phosphorous and especially zinc content for use in lubricating and functional fluids. The reduced sulfur compositions allow for passage of the L-38 engine bearing wear test when the compositions are used in oils of lubricating viscosity. The compositions contain reaction products of phosphous organosulfides and other sulfides with sulfur scavenging agents which remove bound sulfur from said sulfides.

BACKGROUND OF THE INVENTION

Engine lubricating oils require the presence of additives to protect the engine from wear. Specifically engines must be protected from copper-lead bearing wear as measured by the CRC L-38 Test Method for Evaluation of Automatove Engine Oils (D-5119-92). U.S. patent Ser. No. 08/530,454 filed Sep. 19, 1995, (European Patent Application No. 96306797.0 filed Sep. 18, 1996) describes the use of organophosphorous disulfides in oil compositions to protect engines from wear. Also, the lubricating oils disclosed have reduced phosphorous and zinc contents while at the same time providing the desired anti-wear properties. The European Patent Application No. 96306797.0 is incorporated herein by reference in its entirety.

It is described in the referenced European Patent Application that for almost 40 years, the principal antiwear additive for engine lubricating oils has been zinc dialkyl dithiophosphate (ZDDP). However, ZDDP is typically used in the lubricating oil at a sufficient concentration to provide a phosphorus content of up to 0.12% by weight or higher in order to pass required industry standard tests for antiwear. Since phosphates may result in the deactivation of emission control catalysts used in automotive exhaust systems, a reduction in the amount of phosphorus-containing additives (e.g., ZDDP) in the oil would be desirable. The problem in the European patent application sought to be overcome is to provide for a reduction in the amount of phosphorus-containing additive in the lubricating oil and yet provide the lubricating oil with desired antiwear properties. The present invention provides a solution to this problem by providing compositions that can function as either a partial or complete replacement for ZDDP and also which provide for specific bearing wear protection.

The use of dithiophosphate polysulfides as additives for lubricating compositions is disclosed in U.S. Pat. Nos. 2,343,831; 2,443,264; 2,471,115; 2,526,497; 2,591,577; 3,687,848; 3,742,099; 3,770,854; and 3,885,001.

The use of acylated nitrogen compounds as dispersants in lubricants is disclosed in numerous patents, including U.S. Pat. Nos. 3,172,892; 3,219,666; 3,272,746; 3,310,492; 3,341,542; 3,444,170; 3,455,831; 3,455,832; 3,576,743; 3,630,904; 3,632,511; 3,804,763; and 4,234,435.

The use of metal salts of phosphorodithioic acids as additives for lubricants is disclosed in U.S. Pat. Nos. 4,263,150; 4,289,635; 4,308,154; 4,322,479; and 4,417,990. Amine salts of such acids are disclosed as being useful as additives for grease compositions in U.S. Pat. No. 5,256,321.

The book "Lubricant Additives" by M. W. Ranney, published by Noyes Data Corporation of Parkridge, N.J. (1973), discloses a number of overbased metal salts of various sulfonic acids which are useful as detergent/dispersant in lubricants. The book also entitled "Lubricant Additives" by C. V. Smallheer and R. K. Smith, published by the Lezius-Hiles Co. of Cleveland, Ohio (1967), similarly discloses a number of overbased sulfonates which are useful as dispersants. U.S. Pat. No. 4,100,082 discloses the use of neutral or overbased metal salts of organic sulfur acids as detergent/dispersants for use in fuels and lubricants.

U.S. Pat. No. 4,758,362 discloses the addition of a carbamate to a low phosphorus or phosphorus free lubricating oil composition to provide a composition with enhanced extreme-pressure and antiwear properties.

U.S. Pat. No. 5,034,141 discloses that improved antiwear results can be obtained by combining a thiodixanthogen (e.g., octylthiodixanthogen) with a metal thiophosphate (e.g., ZDDP). U.S. Pat. No. 5,034,142 discloses the addition of a metal alkoxyalkylxanthate (e.g., nickel ethoxyethylxanthate), a dixanthogen (e.g., diethoxyethyl dixanthogen) and a metal thiophosphate (e.g., ZDDP) to a lubricant to improve antiwear.

U.S. Pat. No. 4,263,150 discloses treating dialkylphosphoro dithioic acids having excess sulfur with phosphite compounds to remove active sulfur.

SUMMARY OF THE INVENTION

This invention relates to a compositions, comprising: reaction products (AT) formed from by reacting a compound represented by the formula

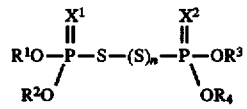

(A)

with a compound capable of reducing the bound sulfur in (A), wherein in Formula (A), $R^1$, $R^2$, $R^3$ and $R^4$ are independently hydrocarbyl groups, $X^1$ and $X^2$ are independently O or S, and n is zero to 3; and (B) an acylated nitrogen-containing compound having a substituent of at least 10 aliphatic carbon atoms. The compositions, when added to engine oils, allow the oil to pass the L-38 engine bearing wear test. In one embodiment, the inventive composition further comprises (C) a second phosphorus compound other than (A), said second phosphorus compound being a phosphorus acid, phosphorus acid ester, phosphorus acid salt, or derivative thereof. In one embodiment, the inventive composition further comprises (D) an alkali or alkaline earth metal salt of an organic sulfur acid, carboxylic acid or phenol. In one embodiment, the inventive composition further comprises (E) a thiocarbamate. In one embodiment the inventive composition further comprises (F) a phosphorous free organic sulfide.

When (E) and (F) are disulfides, they may be treated with the same bound sulfur reducing compounds as used to reduce bound sulfur in (A) whereby bound sulfur is reduced in (E) and (F). In compositions of this invention, (A) and (B) are required. In some embodiments (A) and (B) may be used with (C), (D), (E) and/or (F) either alone or in combination. The combination of (A), (B) and (C) may also be used with various compounds of (D), (E) and/or (F) either singularly or in mixtures.

These compositions are useful in providing lubricating compositions and functional fluids with enhanced antiwear properties. In one embodiment, these lubricating compositions and functional fluids are characterized by reduced phosphorus levels when compared to those in the prior art, and yet have sufficient antiwear properties to pass industry standard tests for antiwear such as the L-38 bearing wear test. In one embodiment, these compositions also provide such lubricating compositions and functional fluids with enhanced extreme pressure and/or antioxidant properties. The inventive compositions are especially suitable for use in engine lubricating oil compositions, automatic transmission fluids and hydraulic fluids.

DESCRIPTION OF THE PREFERRED EMBODIMENTS

As used in this specification and in the appended claims, the terms "hydrocarbyl" and "hydrocarbon based" denote a group having a carbon atom directly attached to the remainder of the molecule and having a hydrocarbon or predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based," "aryl-based," and the like have meanings analogous to the above with respect to alkyl groups, aryl groups and the like.

The term "hydrocarbon-based" has the same meaning and can be used interchangeably with the term hydrocarbyl when referring to molecular groups having a carbon atom attached directly to the remainder of a molecule.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about one gram per liter at 25° C.

(A) Phosphorus-Containing Sulfide.

The phosphorus-containing sulfides (A) are represented by the formula

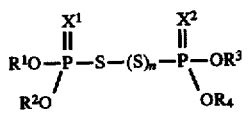

(A)

wherein in Formula (A), $R^1$, $R^2$, $R^3$ and $R^4$ are independently hydrocarbyl groups, $X^1$ and $X^2$ are independently O or S, and n is zero to 3. In one embodiment $X^1$ and $X^2$ are each S, and n is 1. $R^1$, $R^2$, $R^3$ and $R^4$ are independently hydrocarbyl groups that are preferably free from acetylenic unsaturation and usually also free from ethylenic unsaturation. In one embodiment $R^1$, $R^2$, $R^3$ and $R^4$ independently have from about 1 to about 50 carbon atoms, and in one embodiment from about 1 to about 30 carbon atoms, and in one embodiment from about 1 to about 18 carbon atoms, and in one embodiment from about 1 to about 8 carbon atoms. Each $R^1$, $R^2$, $R^3$ and $R^4$ can be the same as the other, although they may be different and mixtures may be used. Examples of $R^1$, $R^2$, $R^3$ and $R^4$ groups include isopropyl, butyl, n-butyl, isobutyl, amyl, 4-methyl-2-pentyl, octyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and mixtures thereof.

The compounds represented by Formula (A) can be prepared by first reaction an alcohol, phenol or aliphatic or aromatic mercaptan with a sulfide of phosphorus, such as $P_2S_3$, $P_2S_5$, $P_4S_3$, $P_4S_7$, $P_4S_{10}$, and the like, to form a partially esterified thiophosphorus or thiophosphoric acid, and then further reactiong this product as such or in the form of a metal salt with an oxidizing agent or with a sulfur halide. Thus, when an alcohol is reacted with phosphorus trisulfide, a dialkylated monothiophosphorus acid is formed according to the following equation:

$$4ROH+P_2S_3 \rightarrow 2(RO)_2PSH+H_2S$$

This alkylated thiophosphorus acid may then be treated with an oxidizing agent such as hydrogen peroxide or with sulfur dichloride or sulfur monochloride to form a disulfide, trisulfide, or tetrasulfide, respectively, according to the following equations:

$$4(RO)_2PSH+O_2 \rightarrow 2(RO)_2P—S—S—P(OR)_2+2H_2O$$

$$2(RO)_2PSH+SCl_2 \rightarrow (RO)_2P—S—S—S—P(OR)_2+2HCl$$

$$2(RO)_2PSH+S_2Cl_2 \rightarrow (RO)_2P—S—(S)_2—S—P—(OR)_2+2HCl$$

Similarly, when the alcohol is reacted with phosphorus pentasulfide, the corresponding di-substituted dithiophosphoric acid is formed, and this may likewise be converted into disulfide, trisulfide or tetrasulfide compounds. Suitable alcohols such as those discussed below may be employed. Sulfurized alcohols such as sulfurized oleyl alcohol may also be used. Corresponding reactions take place by starting with mercaptans, phenols or thiophenols instead of alcohols. Suitable oxidizing agents for converting the thiophosphorus and thiophosphoric acids to disulfides include iodine, potassium triodide, ferric chloride, sodium hypochlorite, hydrogen peroxide, oxygen, etc.

Alcohols used to prepare the phosphorus-containing sulfides of Formulae (A-I) include isopropyl, n-butyl, isobutyl, amyl, 4-methyl-2-pentyl, hexyl, isooctyl, decyl, dodecyl, tetradecyl, 2-pentenyl, dodecenyl, and aromatic alcohols such as the phenols, etc. Higher synthetic monohydric alcohols of the type formed by Oxo process (e.g., 2-ethylhexyl), the Aldol condensation, or by organoaluminum catalyzed oligomerization of alpha-olefins (especially ethylene), followed by oxidation and hydrolysis, also are useful. Examples of useful monohydric alcohols and alcohol mixtures include the commercially available "Alfol" alcohols marketed by Continental Oil Corporation. Alfol 810 is a mixture of alcohols containing primarily straight chain, primary alcohols having from 8 to 10 carbon atoms. Alfol 12 is a mixture of alcohols containing mostly $C_{12}$ fatty alcohols.

Alfol 1218 is a mixture of synthetic, primary, straight-chain alcohols containing primarily 12 to 18 carbon atoms. The Alfol 20+ alcohols are mixtures of $C_{18}$–$C_{28}$ primary alcohols having mostly, on an alcohol basis, $C_{20}$ alcohols as determined by GLC (gas-liquid-chromatography). The Alfol 22+ alcohols are $C_{18}$–$C_{28}$ primary alcohols containing primarily, on an alcohol basis, $C_{22}$ alcohols. These Alfol alcohols can contain a fairly large percentage (up to 40% by weight) of paraffinic compounds which can be removed before the reaction if desired.

Another example of a commercially available alcohol mixture is Adol 60 which comprises about 75% by weight of a straight chain $C_{22}$ primary alcohol, about 15% of a $C_{20}$ primary alcohol and about 8% of $C_{18}$ and $C_{24}$ alcohols. Adol 320 comprises predominantly oleyl alcohol. The Adol alcohols are marketed by Ashland Chemical.

A variety of mixtures of monohydric fatty alcohols derived from naturally occurring triglycerides and ranging in chain length of from $C_8$ to $C_{18}$ are available from Proctor & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha olefin fraction of $C_{11}$–$C_{14}$, and the latter is derived from a $C_{15}$–$C_{18}$ fraction.

Examples of useful phosphorus acid esters include the phosphoric acid esters prepared by reactiong a phosphoric acid or anhydride with cresol alcohols. An example is tricresyl phosphate.

The following examples illustrate the preparation of phosphorus-containing sulfides (A) that are useful with this invention. In the following example as well as throughout the specification and in the claims, unless otherwise indicated, all parts and percentages are by weight, all temperatures are in degrees Celsius, and all pressures are atmospheric.

EXAMPLE A-1

A phosphorodithioic acid derived from $P_2S_5$ and an alcohol mixture of 40% by weight isopropyl alcohol and 60% by weight 4-methyl-secondary-amyl alcohol (4518 grams, 14.34 equivalents) is charged to a reactor. A 30% aqueous hydrogen peroxide solution (1130 grams, 10.0 moles) is added dropwise at a rate of 7.3 grams per minute. The temperature of the reaction mixture increases from 24° C. to 38° C. A 50% aqueous sodium hydroxide solution (40 grams, 0.50 equivalents) is added. The reaction mixture is stirred for 5 minutes, and then allowed to stand. The mixture separates into two layers. The aqueous layer contains water, phosphorodithioic acid salt and excess alcohol from the phosphorodithioic acid. The organic layer contains the desired product. The top water layer is drawn off (1108 grams) and the remaining organic portion is stripped at 100 C and 20 mm Hg for two hours. The stripped organic product is filtered using a filter aid to provide the desired product which is a phosphorus-containing disulfide in the form of a clear yellow liquid (4060 grams).

EXAMPLE A-2

A phosphorodithioic acid derived from 4-methyl-2-pentanol and $P_2S_5$ (1202 grams, 3.29 equivalents) is charged to a reactor. A 30% aqueous hydrogen peroxide solution (319 grams, 2.82 moles) is added dropwise at a rate of 7.3 grams per minute. The temperature of the reaction mixture increases from 24° C. to 38° C. A 50% aqueous sodium hydroxide solution (12 grams, 0.15 equivalents) is added. The reaction mixture is stirred for 5 minutes, and then allowed to stand. The mixture separates into two layers. The aqueous layer contains water, phosphorodithioic acid salt and excess methylamyl alcohol from the phosphorodithioic acid. The organic layer contains the desired product. The bottom water layer is drawn off and the remaining organic portion is stripped at 100° C. and 20 mm Hg for two hours. The stripped organic product is filtered using a filter aid to provide the desired phosphorous-containing disulfide product which is a clear yellow liquid (1016 grams).

EXAMPLE A-3

Di-(isooctyl)phosphorodithioic acid (991 grams, 2.6 equivalents) and a phosphorodithioic acid derived from $P_2S_5$ and an alcohol mixture consisting of 65% isobutyl alcohol and 35% amyl alcohol (298 grams, 1.0 equivalent) are charged to a reactor. A 30% aqueous hydrogen peroxide solution (294 grams, 2.6 moles) is added dropwise over a period of 1.5 hours. The resulting reaction is exothermic but the temperature of the reaction is maintained at 15°–30° C. using a dry ice bath. After the addition of the hydrogen peroxide is complete the reaction mixture is maintained at room temperature for 2 hours. The mixture is transferred to a separatory funnel and toluene (800 grams) is added. An organic layer is separated. The organic layer is washed with a 50% aqueous sodium hydroxide solution (800 grams) and then washed with one liter of distilled water. The organic layer is dried over $MgSO_4$ and filtered through a glass fritted funnel. The mixture is stripped on a rotary evaporator at 77° C. and 20 mm Hg to provide the desired product which is in the form of a yellow liquid.

EXAMPLE A-4

(a) A mixture of 105.6 grams (1.76 moles) of isopropyl alcohol and 269.3 grams (2.64 moles) of 4-methyl-2-pentanol is prepared and heated to 70° C. Phosphorus pentasulfide (222 grams, 1 mole) is added to the alcohol mixture while maintaining the temperature at 70° C. One mole of hydrogen sulfide is liberated. The mixture is maintained at 70° C. for an additional four hours. The mixture is filtered through diatomaceous earth to yield a green liquid product having an acid number in the range of 179–189.

(b) 44.6 grams (1.09 equivalents) of ZnO are added to diluent oil to form a slurry. One equivalent (based upon the measured acid number) of the phosphorodithioic acid prepared in (a) are added dropwise to the ZnO slurry. The reaction is exothermic. The reaction mixture is stripped to 100° C. and 20 mm Hg to remove water of reaction and excess alcohol. The residue is filtered through diatomaceous earth. The filtrate, which is a viscous liquid, is diluted with diluent oil to provide a final product having a 9.5% by weight phosphorus content.

(c) A mixture of the product of part (a) of this example (184 grams) and part (b) (130 grams) is placed in a reactor. A 30% aqueous hydrogen peroxide solution (80 grams) is added dropwise. After the hydrogen peroxide addition is complete, the reaction mixture is stripped at 70° C. and 20 mm Hg. The reaction mixture is filtered through diatomaceous earth to provide the desired product which is in the form of a yellow liquid.

EXAMPLE A-5

The product of part (b) of Example A-4 (130 grams) is placed in a reactor. A 30% aqueous hydrogen peroxide solution (80 grams) is added dropwise. After the hydrogen peroxide addition is complete, the reaction mixture is stripped at 70° C. and 20 mm Hg. The reaction mixture is filtered through diatomaceous earth to provide the desired product which is in the form of a yellow liquid.

EXAMPLE A-6

1500 grams of diisopropyl dithiophosphoric acid are cooled to 10° C. 725 grams of an aqueous hydrogen peroxide solution (30% $H_2O_2$) are added dropwise to the acid while maintaining the temperature below 30° C. A yellow solid precipitate forms. This precipitate is filtered, rinsed with a 50:50 mixture of toluene and isopropyl alcohol, and air dried to provide the desired disulfide product.

EXAMPLE A-7

166 grams of an aqueous hydrogen peroxide solution (30% $H_2O_2$) are cooled to 10° C. 650 grams of dicresylic acid derived dithiophosphoric acid are added dropwise while maintaining the temperature below 20° C. 100 grams of toluene are then added and the mixture is stirred and allowed to settle. A water layer is separated from the mixture leaving an organic layer. The organic layer is washed with 100 grams of a 5% aqueous sodium hydroxide solution. The aqueous layer that forms is removed and the remaining organic layer is washed with 100 grams of distilled water. The water layer is removed and the remaining organic layer is dried with 30 grams of anhydrous magnesium sulfate. The mixture is filtered through diatomaceous earth and stripped at 70° C. and 20 mm Hg. The resulting viscous liquid is the desired disulfide product.

EXAMPLE A-8

709.8 grams of a phosphorodithioic acid derived from $P_2S_5$ and 4-methyl-2-pentanol are nitrogen sparged for one hour and mixed with 200 grams of toluene. 141.3 grams of aqueous hydrogen peroxide solution (30% $H_2O_2$) are added dropwise over a period of 2.25 hours at a temperature of 25°–40° C. The resulting mixture is stirred for an additional 0 1.5 hours. The mixture is then washed twice using a 5% aqueous sodium hydroxide solution and once using distilled water. 80 grams of magnesium sulfate are added and the mixture is allowed to stand overnight. The mixture is filtered using diatomaceous earth, and then stripped at 70° C. and 20 mm Hg to provide the desired disulfide product.

EXAMPLE A-9

1862 grams of the product of Example A-4(a) are mixed with 433 grams of an aqueous hydrogen peroxide solution (30% $H_2O_2$) while maintaining the temperature below 20° C. 1000 grams of toluene are added. Water is drawn off. 500 grams of water and 5 grams of a 50% aqueous sodium hydroxide solution are added. The mixture is stirred and the water phase is drawn off leaving an organic phase. The organic phase is dried using magnesium sulfate, stripped at 70° C. and 20 mm Hg, and filtered using diatomaceous earth to provide the desired disulfide product which is a clear yellow liquid.

Reduced Sulfur—Phosphorous Containin Sulfides (AT)

As described above, the organophosphorous disulfides provide excellent extreme pressure/anti-wear performance to oils in which they are embodied. A problem at times in use of these compounds in that they are copper reactive and this may cause problems with copper corrosion. Compositions with problems of this nature can have problems passing a copper strip test or an L-38 engine bearing wear test.

It has been discovered that in the synthesis of the organosulfur disulfides (A) polysulfides are also formed. Polysulfides are defined herein as compounds in (A) where n is greater than 1. Copper strip tests with polysulfide containing compositon of (A) and with polysulfide free compositions of (A) and with isolated polysulfides show that the polysulfides are the cause of the copper corrosion.

To reduce copper corrosion, compounds of formula (A) were treated with various compounds to remove bound sulfur thus reducing the sulfur content of (A) and producing reaction products with lower bound sulfur content. Bound sulfur is sulfur in (A) which is bound between the two phosphorus molecules. The compounds used to reduce bound sulfur are arylphosphites, alkylphosphites, aryl and alkyl hydrogen phosphites, and mixtures thereof. Preferred compounds are triarylphosphite and dialkyl-hydrogen phosphite, but any phosphite may be used.

In the synthesis of compounds represented by (A) above, compounds are formed in which n=1, 2, 3 or more. The compositions in which n is greater than 1 are called polysulfides. The components of (A) are determined by GC MS. For example, in the synthesis above of the disulfide the products of Example A-1 trisulfides were identified along with other polysulfide. In Example A-1 the yield of disulfide, (A) where n=1 was about 92.7 percent by weight, the polysulfide where n=2 was 3.6 weight percent and other polysulfides 3.8 weight percent.

Various of the phosphorous containing disulfides synthesized in the Examples A-1 through A-9 above were analyzed by ASTM copper strip corrosion standards, method D130/IP 154, to screen for copper corrosion. In this test numbers less than 4 represent a pass for copper corrosion while numbers 4 (a), (b) and (c) represent a fail. It was found that when the (A) compounds of the Examples A-1 through A-9 above were treated with a compound, preferably triaryl phosphite or dialkyl hydrogen phosphite, to reduce the bound sulfur content of the reaction products (AT) the copper strip test results were generally improved from being failures with scores of 4(a) and below to pass with scores being 3(c) and above. Of course, for the disulfides formed in Examples A-1 to A-9 above, the extent of the polysulfides present in the specific reaction products, effect that compositions ratings.

Example for Sulfur Reduction and Copper Corrosion Test

The reaction product from Example A-1 above was subjected to ASTM copper Strip Corrosion Test at 121° C. at a concentration of 0.125 weight percent in 100N oil for three hours. The test value for this strip was 4A.

The reaction product from Example A-1 was then treated with one mole of triphenyphosphite per mole of polysulfide in the reaction mixture. In this reaction 100 grams (0.168 moles) of the reaction product of Example A-1 was treated with 4.175 grams of triphenyl phosphite (0.0346 moles) at 60° C. for two hours and the resulting liquid was the product (AT). This level of phosphite to phosphoropolysulfide represents a 1:1 treatment level on a molar basis, but ratios of 0.1–5:1 may be used depending on the amount of sulfur reduction desired.

The phosphite treated product of Example A-1 was determined by GC-MS to have an absence of polysulfides but to contain an anhydride (n =0). The overall reation of phosphite treatment of the compounds represented by formula (A) is shown below:

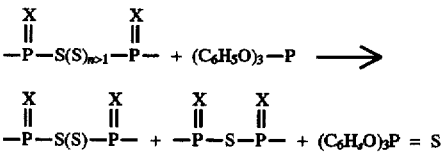

Example For Synthesis of Compounds of (A) With n=0, n=2, n=3

In order to have standards for GC-MS Analysis and Copper Strip Test compounds related to (A) in which n=0, n–2, and n=3 were synthesized.

n=2

Into a 1-liter flask is placed 1 mole of the reaction product of Example A-1 and 0.5 mole of $SnCl_2$ dropwise. There is a slight exotherm to about 30° C. After the $SnCl_2$ has been added, the reaction mixture is kept at 80°. The reaction is filtered to give the clear yellow liquid product, this gives 85% yield of the trisulfide of (A) where n=2. Also formed is 4.8% of the tetrisulfide of (A) where n=3 and 11% of the disulfide of (A) where n=1.

The reaction product of Example A-1, 1 mole, was added to a one-liter flask and treated with 1 mole of dibutyl hydrogen phosphite at 65° C. for four hours. This gives the monosulfide version of (A) where n=0.

It will be recognized that as well a compounds represented by formula (A) were n is greater than 1, compounds represented by formula (E-I) and especially the compounds represented by (E-VII) and E-VIII) may also contain polysulfides and removal of said polysulfides therefrom would be beneficial for the same reasons as removing polysulfides from (A). The same holds true for organic sulfide compounds (F).

Gas Chromotography Mass Spec Experiments (GC-MS)

GC-MS was employed for analysis of the various phosphorus sulfide composition because in $^{31}P$ NMR the polysulfide peaks were under the disulfide peaks.

The sulfide-containing components in samples from Example A-I, and Example A-I treated with triphenyl phosphite were determined from the mass spectra obtained on a Finnigan TSQ 700 mass spectrometer. A DEP (direct exposure probe) was used to introduce the samples into the mass spectrometer.

A solution of each sample was prepared in chloroform to give a final concentration of approximately 20 micrograms per microliter. A one-icroliter aliquot of the test sample in chloroform was transferred by syringe to the DEP. The DEP was inserted ito the mass spectrometer and heated.

The following instrument conditions were used to collect mass spectra:

| Finigan TSQ 700 | |
|---|---|
| filament | 70 eV |
| multiplier | 1000 mV |
| ioniation mode | + (positive) |
| source temperature | 150° C. |
| manifold temperature | 70° C. |
| Cl reagent gas | isobutane at 4000 mT |
| DEP Temperature Program | 50° C. (5 min.) |
| | 50–850° C. (800 C/min) |

(B) The Acylated Nitrogen-Containing Compounds.

A number of acylated, nitrogen-containing compounds having a substituent of at least 10 aliphatic carbon atoms and made by reactiong acarboxylic acid acylating agent with an amino compound are known to those skilled in the art. In such compositions the acylating agent is linked to the amino compound through an imido, amido, amidine or salt linkage. The substituent of at least 10 aliphatic carbon atoms may be in either the carboxylic acid acylating agent derived portion of the molecule or in the amino compound derived portion of the molecule. Preferably, however, it is in the acylating agent portion. The acylating agent can vary from formic acid and its acylating derivatives to acylating agents having high molecular weight aliphatic substituents of up to 5,000, 10,000 or 20,000 carbon atoms. The amino compounds can vary from ammonia itself to amines having aliphatic substituents of up to about 30 carbon atoms.

A typical class of acylated amino compounds useful in the compositions of this invention are those made by reactiong an acylating agent having an aliphatic substituent of at least 10 carbon atoms and a nitrogen compound characterized by the presence of at least one —NH—group. Typically, the acylating agent will be a mono- or polycarboxylic acid (or reactive equivalent thereof) such as a substituted succinic or propionic acid and the amino compound will be a polyamine or mixture of polyamines, most typically, a mixture of ethylene polyamines. The amine also may be a hydroxyalkyl-substituted polyamine. The aliphatic substituent in such acylating agents preferably averages at least about 30 or 50 and up to about 400 carbon atoms.

Illustrative hydrocarbon based groups containing at least 10 carbon atoms are n-decyl, n-dodecyl, tetrapropenyl, n-octadecyl, oleyl, chlorooctadecyl, triicontanyl, etc. Generally, the hydrocarbon-based substituents are made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monoolefins. The substituent can also be derived from the halogenated (e.g., chlorinated or brominated) analogs of such homo- or interpolymers. The substituent can, however, be made from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the substituent may be reduced or eliminated by hydrogenation according to procedures known in the art.

The hydrocarbon-based substituents are substantially saturated, that is, they contain no more than one carbon-to carbon unsaturated bond for every ten carbon-to-carbon single bonds present. Usually, they contain no more than one carbon-to-carbon non-aromatic unsaturated bond for every 50 carbon-to-carbon bonds present.

The hydrocarbon-based substituents are also substantially aliphatic in nature, that is, they contain no more than one non-aliphatic moiety (cycloalkyl, cycloalkenyl or aromatic) group of 6 or less carbon atoms for every 10 carbon atoms in the substituent. Usually, however, the substituents contain no more than one such non-aliphatic group for every 50 carbon atoms, and in many cases, they contain no such non-aliphatic groups at all; that is, the typical substituents are purely aliphatic. Typically, these purely aliphatic substituents are alkyl or alkenyl groups.

Specific examples of the substantially saturated hydrocarbon-based substituents containing an average of more than 30 carbon atoms are the following:

- a mixture of poly(ethylene/propylene) groups of about 35 to about 70 carbon atoms
- a mixture of the oxidatively or mechanically degraded poly(ethylene/propylene) groups of about 35 to about 70 carbon atoms
- a mixture of poly(propylene/1-hexene) groups of about 80 to about 150 carbon atoms
- a mixture of poly(isobutene) groups having an average of about 50 to about 200 carbon atoms A useful source of the substituents are poly(isobutene)s obtained by polymerization of a $C_4$ refinery stream having a butene content of about 35 to about 75 weight percent and isobutene content of about 30 to about 60 weight percent in the presence of a Lewis acid catalyst such as aluminum trichloride or boron trifluoride. These polybutenes contain predominantly (greater than 80% of total repeating units) isobutene repeating units of the configuration

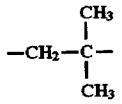

The amines may be primary, secondary or tertiary amines, or mixtures thereof. Hydrocarbyl groups of the amines may be aliphatic, cycloaliphatic or aromatic. These include alkyl and alkenyl groups. In one embodiment the amine is an alkylamine wherein the alkyl group contains from 1 to about 50 carbon atoms, and in one embodiment 1 to about 30 carbon atoms.

In one embodiment, the amines are primary hydrocarbyl amines containing from about 2 to about 30, and in one embodiment about 4 to about 20 carbon atoms in the hydrocarbyl group. The hydrocarbyl group may be saturated or unsaturated. Representative examples of primary saturated amines are the alkylamines such as methylamine, n-butylamine, n-hexylamine; those known as aliphatic primary fatty amines, for example, the commercially known "Armeen" primary amines (products available from Akzo Chemicals, Chicago, Ill.). Typical fatty amines include amines such as, n-octylamine, n-dodecylamine, n-tetradecylamine, n-octadecylamine (stearylamine), octadecenylamine (oleylamine), etc. Also suitable are mixed fatty amines such as Akzo's Armeen-C, Armeen-O,Armeen-OD, Armeen-T, Armeen-HT, Armeen S and Armeen SD, all of which are fatty amines of varying purity.

In one embodiment, the amine is a tertiary-aliphatic primary amine having from about 4 to about 30, and in one embodiment about 6 to about 24, and in one embodiment about 8 to about 24 carbon atoms in the aliphatic group. Usually the tertiary-aliphatic primary amines are monoamines, and in one embodiment alkylamines represented by the formula:

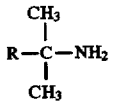

wherein R is a hydrocarbyl group containing from 1 to about 30 carbon atoms. Such amines are illustrated by tertiary-butylamine, 1-methyl-1-amino-cyclohexane, tertiary-octyl primary amine, tertiary-tetradecyl primary amine, tertiary-hexadecyl primary amine, tertiary-octadecyl primary amine, tertiary-octacosanyl primary amine.

Mixtures of tertiary alkyl primary amines are also useful for the purposes of this invention. Illustrative of amine mixtures of this type are "Primene 81R" which is a mixture of $C_{11-14}$ tertiary alkyl primary amines and "Primene JMT" which is a similar mixture of $C_{18-22}$ tertiary alkyl primary amines (both are available from Rohm and Haas). The tertiary alkyl primary amines and methods for their preparation are known to those of ordinary skill in the art. The tertiary-alkyl primary amine useful for the purposes of this invention and methods for their preparation are described in U.S. Pat. No. 2,945,749 which is hereby incorporated by reference for its teachings in this regard.

Primary amines in which the hydrocarbyl group comprises olefinic unsaturation also are useful. Thus, the hydrocarbyl groups may contain one or more olefinic unsaturation depending on the length of the chain, usually no more than one double bond per 10 carbon atoms. Representative amines are dodecenylamine, oleylamine and linoleylamine. Such unsaturated amines are available under the Armeen tradename.

Secondary amines include dialkylamines having two of the above hydrocarbyl, preferably alkyl or alkenyl groups described for primary amines including such commercial fatty secondary amines as Armeen 2C and Armeen HT, and also mixed dialkylamines wherein, for example, one alkyl group is a fatty group and the other alkyl group may be a lower alkyl group (1–7 carbon atoms) such as ethyl, butyl, etc., or the other hydrocarbyl group may be an alkyl group bearing other non-reactive or polar substituents (CN, alkyl, carbalkoxy, amide, ether, thioether, halo, sulfoxide, sulfone) such that the essentially hydrocarbon character of the group is not destroyed.

Tertiary amines such as trialkyl or trialkenyl amines and those containing a mixture of alkyl and alkenyl amines are useful. The alkyl and alkenyl groups are substantially as described above for primary and secondary amines.

Other useful primary amines are the primary etheramines represented by the formula $R''OR'NH_2$ wherein R' is a divalent alkylene group having 2 to about 6 carbon atoms and R" is a hydrocarbyl group of about 5 to about 150 carbon atoms. These primary etheramines are generally prepared by the reaction of an alcohol R"OH wherein R" is as defined hereinabove with an unsaturated nitrile. Typically, the alcohol is a linear or branched aliphatic alcohol with R" having up to about 50 carbon atoms, and in one embodiment up to about 26 carbon atoms, and in one embodiment from about 6 to about 20 carbon atoms. The nitrile reactant can have from about 2 to about 6 carbon atoms, with acrylonitrile being useful. Ether amines are commercially available under the name SURFAM marketed by Mars Chemical Company, Atlanta, Ga. Typical of such amines are those having a molecular weight of from about 150 to about 400. Useful etheramines are exemplified by those identified as SURFAM P14B (decyloxypropylamine), SURFAM P16A (linear $C_{16}$), SURFAM P17B (tridecyloxypropylamine). The hydrocarbyl chain lengths (i.e., $C_{14}$, etc.) of the SURFAM described above and used hereinafter are approximate and include the oxygen ether linkage. For example, a $C_{14}$ SURFAM amine would have the following general formula:

$$C_{10}H_{21}OC_3H_6NH_2$$

The amines may be hydroxyamines. In one embodiment, these hydroxyamines can be represented by the formula

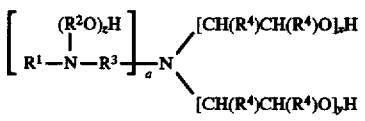

wherein $R^1$ is a hydrocarbyl group generally containing from about 6 to about 30 carbon atoms, $R^2$ is an ethylene or propylene group, $R^3$ is an alkylene group containing up to about 5 carbon atoms, a is zero or one, each $R^4$ is hydrogen or a lower alkyl group, and x, y and z are each independently integers from zero to about 10, at least one of x, y and z being at least 1. The above hydroxyamines can be prepared by techniques well known in the art, and many such hydroxyamines are commercially available. Useful hydroxyamines where in the above formula a is zero include 2-hydroxyethylhexylamine, 2-hydroxyethyloleylamine, bis (2-hydroxyethyl)hexylamine, bis(2-hydroxyethyl) oleylamine, and mixtures thereof. Also included are the comparable members wherein in the above formula at least one of x and y is at least 2.

A number of hydroxyamines wherein a is zero are available from Armak under the general trade designation "Ethomeen" and "Propomeen." Specific examples include "Ethomeen C/15" which is an ethylene oxide condensate of a coconut fatty amine containing about 5 moles of ethylene oxide; "Ethomeen C/20" and "C/25" which also are ethylene oxide condensation products from coconut fatty amine containing about 10 and 15 moles of ethylene oxide, respectively. "Propomeen O/12" is the condensation product of one mole of oleylamine with 2 moles propylene oxide.

Commercially available examples of alkoxylated amines where a is 1 include "Ethoduomeen T/13" and "T/20" which are ethylene oxide condensation products of N-tallow trimethylenediamine containing 3 and 10 moles of ethylene oxide per mole of diamine, respectively.

The fatty diamines include mono- or dialkyl, symmetrical or asymmetrical ethylenediamines, propanediamines (1,2 or 1,3) and polyamine analogs of the above. Suitable fatty polyamines such as those sold under the name Duomeen are commercially available diamines described in Product Data Bulletin No. 7-10$R_1$ of Armak. In another embodiment, the secondary amines may be cyclic amines such as piperidine, piperazine, morpholine, etc.

The amines that are useful include the following:

(1) polyalkylene polyamines of the general formula

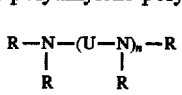

(B-I)

wherein in Formula (B-I), each R is independently a hydrogen atom or a hydrocarbyl group or a hydroxy-substituted hydrocarbyl group containing up to about 30 carbon atoms, with the proviso that at least one R is a hydrogen atom, n is a number of 1 to about 10, and U is an alkylene group containing 1 to about 18 carbon atoms;

(2) heterocyclic-substituted polyamines including hydroxyalkyl-substituted polyamines wherein the polyamines are as described above and the heterocyclic substituent is, e.g., a piperazine, an imidazoline, a pyrimidine, a morpholine, etc.; and (3) aromatic polyamines of the general formula $$Ar(NR_2)_y \qquad \text{(B-II)}$$

wherein in Formula (B-II), Ar is an aromatic nucleus of 6 to about 20 carbon atoms, each R is independently a hydrogen atom or a hydrocarbyl group or a hydroxy-substituted hydrocarbyl group containing up to about 30 carbon atoms, with proviso that at least one $R^3$ is a hydrogen atom, and y is 2 to about 8.

Specific examples of the polyalkylenepolyamines (1) are ethylenediamine, tetra(ethylene)pentamine, tri-(trimethylene)tetramine, 1,2-propylenediamine, etc. Specific examples of hydroxyalkyl-substituted polyamines include N-(2-hydroxyethyl) ethylene diamine, N,$N^1$-bis(2-hydroxyethyl) ethylene diamine, N-(3-hydroxybutyl) tetramethylene diamine, etc. Specific examples of the heterocyclic-substituted polyamines (2) are N-2-aminoethylpiperazine, N-2- and N-3-aminopropylmorpholine, N-3-(dimethylamine) propylpiperazine, 2-heptyl-3-(2-aminopropylimidazoline), 1,4-bis(2-aminoethyl) piperazine, 1-(2-hydroxyethylpiperazine), and 2-heptadecyl-1-(2-hydroxyethyl)-imidazoline, etc. Specific examples of the aromatic polyamines (3) are the various isomeric phenylene diamines, the various isomeric naphthalenediamines, etc.

Many patents have described useful acylated nitrogen compounds including U.S. Pat. Nos. 3,172,892; 3,219,666; 3,272,746; 3,310,492; 3,341,542; 3,444,170; 3,455,831; 3,455,832; 3,576,743; 3,630,904; 3,632,511; 3,804,763; and 4,234,435. A typical acylated nitrogen-containing compound of this class is that made by reactiong a poly (isobutene)-substituted succinic anhydride acylating agent (e.g., anhydride, acid, ester, etc.) wherein the poly (isobutene) substituent has between about 50 to about 400 carbon atoms with a mixture of ethylene polyamines having 3 to about 7 amino nitrogen atoms per ethylene polyamine and about 1 to about 6 ethylene units made from condensation of ammonia with ethylene chloride. In view of the extensive disclosure of this type of acylated amino compound, further discussion of their nature and method of preparation is not needed here. Instead, the above-noted U.S. patents are hereby incorporated by reference for their disclosure of acylated amino compounds and their method of preparation.

Another type of acylated nitrogen compound belonging to this class is that made by reactiong a carboxylic acid acylating agent with a polyamine, wherein the polyamine is the product made by condensing a hydroxy material with an amine. These compounds are described in U.S. Pat. No. 5,053,152 which is incorporated herein by reference for its disclosure of such compounds.

Another type of acylated nitrogen compound belonging to this class is that made by reactiong the afore-described alkyleneamines with the afore-described substituted succinic acids or anhydrides and aliphatic monocarboxylic acids having from 2 to about 22 carbon atoms. In these types of acylated nitrogen compounds, the mole ratio of succinic acid to monocarboxylic acid ranges from about 1:0.1 to about 1:1. Typical of the monocarboxylic acid are formic acid, acetic acid, dodecanoic acid, butanoic acid, oleic acid, stearic acid, the commercial mixture of stearic acid isomers known as isostearic acid, tall oil acid, etc. Such materials are more fully described in U.S. Pat. Nos. 3,216,936 and 3,250,715 which are hereby incorporated by reference for their disclosures in this regard.

Still another type of acylated nitrogen compound useful in making the compositions of this invention is the product of the reaction of a fatty monocarboxylic acid of about 12–30 carbon atoms and the afore-described alkylene amines, typically, ethylene-, propylene- or trimethylene-polyamines containing 2 to 8 amino groups and mixtures thereof. The fatty monocarboxylic acids are generally mixtures of straight and branched chain fatty carboxylic acids containing 12–30 carbon atoms. A widely used type of acylated nitrogen compound is made by reactiong the afore-described alkylenepolyamines with a mixture of fatty acids having from 5 to about 30 mole percent straight chain acid and about 70 to about 95% mole branched chain fatty acids. Among the commercially available mixtures are those known widely in the trade as isostearic acid. These mixtures are produced as a by-product from the dimerization of unsaturated fatty acids as described in U.S. Pat. Nos. 2,812,342 and 3,260,671.

The branched chain fatty acids can also include those in which the branch is not alkyl in nature, such as found in phenyl and cyclohexyl stearic acid and the chloro-stearic acids. Branched chain fatty carboxylic acid/alkylene polyamine products have been described extensively in the art. See for example, U.S. Pat. Nos. 3,110,673; 3,251,853; 3,326,801; 3,337,459; 3,405,064; 3,429,674; 3,468,639; 3,857,791. These patents are hereby incorporated by reference for their disclosure of fatty acid/polyamine condensates for use in lubricating oil formulations.

The following examples illustrate the preparation of acylated nitrogen-containing compounds that are useful with this invention.

EXAMPLE B-1

1000 parts by weight of polyisobutenyl (Mn=1700) succinic anhydride and 1270 parts by weight of diluent oil are blended together and heated to 110° C. 59.7 parts by weight of a mixture of polyethyleneamine bottoms and diethylenetriamine are added over a two-hour period. The mixture exotherms to 121°–132° C. The mixture is heated to 149° C. with nitrogen blowing. The mixture is maintained at 149°–154° C. for one hour with nitrogen blowing. The mixture is then filtered at 149° C. Diluent oil is added to provide a mixture having an oil content of 55% by weight.

EXAMPLE B-2

A blend of 800 parts by weight of polyisobutenyl (Mn=940) succinic anhydride and 200 parts by weight of diluent oil is heated to 150° C. with a nitrogen sparge. 87.2 parts by weight of methylpentaerythritol are added over a one-hour period while maintaining the temperature at 150°–160° C. The mixture is heated to 204° C. over a period of eight hours, and maintained at 204°–210° C. for six hours. 15.2 parts by weight of a mixture of polyethyleneamine bottoms and diethylenetriamine are added over a one-hour period while maintaining the temperature of the mixture at 204°–210° C. 519.5 parts of diluent oil are added to the mixture while maintaining the temperature at a minimum of 177° C. The mixture is cooled to 130° C. and filtered to provide the desired product.

EXAMPLE B-3

(a) A mixture of 76.4 parts by weight of HPA-X (a product of Union Carbide identified as a polyamine bottoms product having a nitrogen content of 31.5% by weight and an average base number of 1180) and 46.7 parts by weight of THAM (trishydroxymethyl aminomethane) are heated at a temperature of 220° C. under condensation reaction conditions in the presence of 1.25 parts by weight of an 85% by weight phosphoric acid aqueous solution to form a condensed polyamine. 1.7 parts by weight a 50% aqueous solution of NaOH are then added to the reaction mixture to neutralize the phosphoric acid. The resulting product is a condensed polyamine having the following properties: viscosity at 40° C. of 6500 cSt; viscosity at 100° C. of 90 cSt; total base number of 730; and nitrogen content of 27% by weight.

(b) A mixture of 1000 parts by weight of polyisobutenyl (Mn=940) succinic anhydride and 400 parts by weight of diluent oil are charged to a reactor while mixing under a $N_2$ purge. The batch temperature is adjusted to 88° C. 152 parts by weight of the condensed polyamine from part (a) are charged to the reactor while maintaining the reactor temperature at 88°–93° C. The molar ratio of acid to nitrogen is 1 COOH: 1.55N. The batch is mixed for two hours at 82°–96° C., then heated to 152° C. over 5.5 hours. The $N_2$ purge is discontinued and submerged $N_2$ blowing is begun. The batch is blown to a water content of 0.30% by weight or less at 149°–154° C., cooled to 138°–149° C. and filtered. Diluent oil is added to provide an oil content of 40% by weight. The resulting product has a nitrogen content of 2.15% by weight, a viscosity at 100° C. of 210 cSt, and a total base number of 48.

EXAMPLE B-4

A mixture of 108 parts by weight of a polyamine mixture (15% by weight diethylenetriamine and 85% by weight polyamine bottoms) and 698 parts by weight diluent oil is charged to a reactor. 1000 parts by weight of polyisobutenyl (Mn =940) succinic anhydride are charged to the reactor under a $N_2$ purge while maintaining the batch temperature at 110°–121° C. The molar ratio of acid to nitrogen is 1 COOH: 1.5N. After neutralization submerged $N_2$ blowing is begun. The batch is heated to 143°–149° C., and then filtered. Diluent oil is added to provide an oil content of 40% by weight. The resulting product has a nitrogen content of 2.0% by weight, a viscosity at 100° C. of 135–155 cSt, and a total base number of 55.

EXAMPLE B-5

(a) A mixture of 100 parts by weight of polyisobutenyl (Mn=940) succinic anhydride, 143 parts of a mixture of polyethylene amine bottoms and diethylenetriamine, and 275 parts of diluent oil are blended together and blown with nitrogen until reaction between the succinic anhydride and the amine is complete.

(b) 1405 parts by weight of the product from part (a), 229 parts of boric acid and 398 parts of diluent oil are blended together and blown with nitrogen until reaction with the boric acid is complete. The reaction mixture is filtered, and diluent oil is added to provide the mixture with an oil content of 33% by weight.

EXAMPLE B-6

A mixture of 1000 parts by weight of polyisobutenyl (Mn=940) succinic anhydride and 722 parts of diluent oil is blown with nitrogen and heated to 93.3° C. 111.3 parts of a coupled polyamine are added over a period of 5 hours while the temperature of the reaction mixture increases to 115.6° C. The mixture is heated to 148.9° C. while maintaining a nitrogen purge on the vapor space. At 148.9° C. the nitrogen purge is switched to a submerged probe and the mixture is dried to a maximum water content of 0.3% by weight. The mixture is filtered, and diluent oil is added to provide an oil content of 39–41% by weight.

EXAMPLE B-7

1000 grams of polyisobutenyl (Mn=940) succinic anhydride are heated to 149° C. with nitrogen blowing. 598.1 grams of blend oil are added and the temperature of the mixture is adjusted to 88°–93° C. 208.9 grams of N,N-diethyethanolamine are added while maintaining the reaction mixture at 88°–93° C. The mixture is held with mixing for one hour to provide the desired product.

(C) Second Phosphorus Compound.

The second phosphorus compound (C) is an optional ingredient, but when present can be a phosphorus acid, ester or derivative thereof. These include phosphorus acid, phosphorus acid ester, phosphorus acid salt, or derivative thereof. The phosphorus acids include the phosphoric, phosphonic, phosphinic and thiophosphoric acids including dithiophosphoric acid as well as the monothiophosphoric, thiophosphinic and thiophosphonic acids.

The phosphorus compound (C) can be a phosphorus acid ester derived from a phosphorus acid or anhydride and an alcohol of 1 to about 50 carbon atoms, and in one embodiment 1 to about 30 carbon atoms. It can be a phosphite, a monothiophosphate, a dithiophosphate, or a dithiophosphate disulfide. It can also be a metal, amine or ammonium salt of a phosphorus acid or phosphorus acid ester. It can be a phosphorus containing amide or a phosphorus-containing carboxylic ester.

The phosphorus compound can be a phosphate, phosphonate, phosphinate or phosphine oxide. These compounds can be represented by the formula

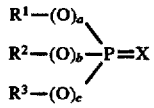

(C-I)

wherein in Formula (C-I), $R^1$, $R^2$ and $R^3$ are independently hydrogen or hydrocarbyl groups, X is O or S, and a, b and c are independently zero or 1.

The phosphorus compound can be a phosphite, phosphonite, phosphinite or phosphine. These compounds can be represented by the formula:

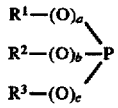

(C-II)

wherein in Formula (C-II), $R^1$, $R^2$ and $R^3$ are independently hydrogen or hydrocarbyl groups, and a, b and c are independently zero or 1.

The total number of carbon atoms in $R^1$, $R^2$ and $R^3$ in each of the above Formulae (C-I) and (C-II) must be sufficient to render the compound soluble in the low-viscosity oil used in formulating the inventive compositions. Generally, the total number of carbon atoms in $R^1$, $R^2$ and $R^3$is at least about 8, and in one embodiment at least about 12, and in one embodiment at least about 16. There is no limit to the total number of carbon atoms in $R^1$, $R^2$ and $R^3$ that is required, but a practical upper limit is about 400 or about 500 carbon atoms. In one embodiment, $R^1$, $R^2$ and $R^3$ in each of the above formulae are independently hydrocarbyl groups of 1 to about 100 carbon atoms, or 1 to about 50 carbon atoms, or 1 to about 30 carbon atoms, with the proviso that the total number of carbons is at least about 8. Each $R^1$, $R^2$ and $R^3$ can be the same as the other, although they may be different. Examples of useful $R^1$, $R^2$ and $R^3$ groups include isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and the like.

The phosphorus compounds represented by Formulae (C-I) and (C-II) can be prepared by reactlong a phosphorus acid or anhydride with an alcohol or mixture of alcohols corresponding to $R^1$, $R^2$ and $R^3$ in Formulae (C-I) and (C-II). The phosphorus acid or anhydride is generally an inorganic phosphorus reagent such as phosphorus pentoxide, phosphorus trioxide, phosphorus tetraoxide, phosphorus acid, phosphorus halide, or lower phosphorus esters, and the like. Lower phosphorus acid esters contain from 1 to about 7 carbon atoms in each ester group. The phosphorus acid ester may be a mono, di- or triphosphoric acid ester.

The phosphorus compound (C) can be a compound represented by the formula:

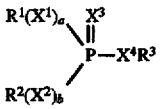

(C-III)

wherein in Formula (C-III): $X^1$, $X^2$, $X^3$ and $X^4$ are independently oxygen or sulfur, and $X^1$ and $X^2$ can be $NR^4$; a and b are independently zero or one; $R^1$, $R^2$ $R^3$ and $R^4$ are independently hydrocarbyl groups, and $R^3$ and $R^4$ can be hydrogen.

Useful phosphorus compounds of the type represented by Formula (C-III) are phosphorus- and sulfur-containing compounds. These include those compounds wherein at least one $X^3$ or $X^4$ is sulfur, and in one embodiment both $X^3$ and $X^4$ are sulfur, at least one $X^1$ or $X^2$ is oxygen or sulfur, and in one embodiment both $X^1$ and $X^2$ are oxygen, a and b are each 1, and $R^3$ is hydrogen. Mixtures of these compounds may be employed in accordance with this invention.

In Formula (C-III), $R^1$ and $R^2$ are independently hydrocarbyl groups that are preferably free from acetylenic unsaturation and usually also from ethylenic unsaturation and in one embodiment have from about 1 to about 50 carbon atoms, and in one embodiment from about 1 to about 30 carbon atoms, and in one embodiment from about 1 to about 18 carbon atoms, and in one embodiment from about 1 to about 8 carbon atoms. Each $R^1$ and $R^2$ can be the same as the other, although they may be different and either or both may be mixtures. Examples of $R^1$ and $R^2$ groups include isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and mixtures thereof. Particular examples of useful mixtures include, for example, isopropyl/n-butyl; isopropyl/secondary butyl; isopropyl/4-methyl-2-pentyl; isopropyl/2-ethyl-1-hexyl; isopropyl/isooctyl; isopropyl/decyl; isopropyl/dodecyl; and isopropyl/tridecyl.

In Formula (C-III), $R^3$ and $R^4$ are independently hydrogen or hydrocarbyl groups (e.g. alkyl) of 1 to about 12 carbon atoms, and in one embodiment 1 to about 4 carbon atoms. $R^3$ is preferably hydrogen.

Phosphorus compounds corresponding to Formula (C-III) wherein $X^3$ and $X^4$ are sulfur can be obtained by the reaction of phosphorus pentasulfide ($P_2S_5$) and an alcohol or mixture of alcohols corresponding to $R^1$ and $R^2$. The reaction involves mixing at a temperature of about 20° C. to about 200° C., four moles of alcohol with one mole of phosphorus pentasulfide. Hydrogen sulfide is liberated in this reaction.

The oxygen-containing analogs of these compounds can be prepared by treating the dithioic acid with water or steam which, in effect, replaces one or both of the sulfur atoms.

In one embodiment, the phosphorus compound (C) is a monothiophosphoric acid ester or a monothiophosphate. Monothiophosphates are prepared by the reaction of a sulfur source and a dihydrocarbyl phosphite. The sulfur source may be elemental sulfur, a sulfide, such as a sulfur coupled olefin or a sulfur coupled dithiophosphate. Elemental sulfur is a useful sulfur source. The preparation of monothiophosphates is disclosed in U.S. Pat. No. 4,755,311 and PCT Publication WO 87/07638 which are incorporated herein by reference for their disclosure of monothiophosphates, sulfur sources for preparing monothiophosphates and the process for making monothiophosphates.

Monothiophosphates may also be formed in the lubricant blend or functional fluid by adding a dihydrocarbyl phosphite to a lubricating oil composition or functional fluid containing a sulfur source. The phosphite may react with the sulfur source under blending conditions (i.e., temperatures from about 30° C. to about 100° C. or higher) to form the monothiophosphate.

In one embodiment, the phosphorus compound (C) is a dithiophosphoric acid or phosphorodithioic acid. The dithiophosphoric acid can be reacted with an epoxide or a glycol to form an intermediate. The intermediate is then reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Propylene oxide is useful. The glycols may be aliphatic glycols having from 1 to about 12, and in one embodiment about 2 to about 6, and in one embodiment 2 or 3 carbon atoms, or aromatic glycols. Aliphatic glycols include ethylene glycol, propylene glycol, triethylene glycol and the like. Aromatic glycols include hydroquinone, catechol, resorcinol, and the like. These are described in U.S. Pat. No. 3,197,405 which is incorporated herein by reference for its disclosure of dithiophosphoric acids, glycols, epoxides, inorganic phosphorus reagents and methods of reactiong the same.

In one embodiment the phosphorus compound (C) is a phosphite. The phosphite can be a di- or trihydrocarbyl phosphite. Each hydrocarbyl group can have from 1 to about 24 carbon atoms, or from 1 to about 18 carbon atoms, or from about 2 to about 8 carbon atoms. Each hydrocarbyl group may be independently alkyl, alkenyl or aryl. When the hydrocarbyl group is an aryl group, then it contains at least about 6 carbon atoms; and in one embodiment about 6 to about 18 carbon atoms. Examples of the alkyl or alkenyl groups include propyl, butyl, hexyl, heptyl, octyl, oleyl, linoleyl, stearyl, etc. Examples of aryl groups include phenyl, naphthyl, heptylphenol, etc. In one embodiment each hydrocarbyl group is independently propyl, butyl, pentyl, hexyl, heptyl, oleyl or phenyl, more preferably butyl, oleyl or phenyl and more preferably butyl or oleyl. Phosphites and their preparation are known and many phosphites are available commercially. Useful phosphites include dibutyl hydrogen phosphite, trioleyl phosphite and triphenyl phosphite.

In one embodiment, the phosphorus compound (C) is a phosphorus-containing amide. The phosphorus-containing amides may be prepared by the reaction of a phosphorus acid (e.g., a dithiophosphoric acid as described above) with an unsaturated amide. Examples of unsaturated amides include acrylamide, N,N -methylene bisacrylamide, methacrylamide, crotonamide, and the like. The reaction product of the phosphorus acid with the unsaturated amide may be further reacted with linking or coupling compounds, such as formaldehyde or paraformaldehyde to form coupled compounds. The phosphorus-containing amides are known in the art and are disclosed in U.S. Pat. Nos. 4,876,374, 4,770,807 and 4,670,169 which are incorporated by reference for their disclosures of phosphorus amides and their preparation.

In one embodiment, the phosphorus compound (C) is a phosphorus-containing carboxylic ester. The phosphorus-containing carboxylic esters may be prepared by reaction of one of the above-described phosphorus acids, such as a dithiophosphoric acid, and an unsaturated carboxylic acid or ester, such as a vinyl or allyl acid or ester. If the carboxylic acid is used, the ester may then be formed by subsequent reaction with an alcohol.

The vinyl ester of a carboxylic acid may be represented by the formula $RCH{=}CH{-}O(O)CR^1$ wherein R is a hydrogen or hydrocarbyl group having from 1 to about 30 carbon atoms, preferably hydrogen or a hydrocarbyl group having 1 to about 12, more preferably hydrogen, and $R^1$is a hydrocarbyl group having 1 to about 30 carbon atoms, preferably 1 to about 12, more preferably 1 to about 8. Examples of vinyl esters include vinyl acetate, vinyl 2-ethylhexanoate, vinyl butanoate, and vinyl crotonate.

In one embodiment, the unsaturated carboxylic ester is an ester of an unsaturated carboxylic acid, such as maleic, fumaric, acrylic, methacrylic, itaconic, citraconic acids and the like. The ester can be represented by the formula $RO{-}(O)C{-}HC{=}CH{-}C(O)OR$ wherein each R is independently a hydrocarbyl group having 1 to about 18 carbon atoms, or 1 to about 12, or 1 to about 8 carbon atoms. Examples of unsaturated carboxylic esters that are useful include methylacrylate, ethylacrylate, 2-ethylhexylacrylate, 2-hydroxyethylacrylate, ethylmethacrylate, 2-hydroxyethylmethacrylate, 2-hydroxypropylmethacrylate, 2-hydroxypropylacrylate, ethylmaleate, butylmaleate and 2-ethylhexylmaleate. The above list includes mono- as well as diesters of maleic, fumaric and citraconic acids.

In one embodiment, the phosphorus compound (C) is the reaction product of a phosphorus acid and a vinyl ether. The vinyl ether is represented by the formula $R{-}CH_2{=}CH{-}OR^1$ wherein R is hydrogen or a hydrocarbyl group having 1 to about 30, preferably 1 to about 24, more preferably 1 to about 12 carbon atoms, and $R^1$ is a hydrocarbyl group having 1 to about 30 carbon atoms, preferably 1 to about 24, more preferably 1 to about 12 carbon atoms. Examples of vinyl ethers include methyl vinylether, propyl vinylether, 2-ethylhexyl vinylether and the like.

When the phosphorus compound (C) is acidic, it may be reacted with an ammonia or a source of ammonia, an amine, or metallic base to form the corresponding salt. The salts may be formed separately and then added to the lubricating oil or functional fluid composition. Alternatively, the salts may be formed when the acidic phosphorus compound (C) is blended with other components to form the lubricating oil or functional fluid composition. The phosphorus compound can then form salts with basic materials which are in the lubricating oil or functional fluid composition such as basic nitrogen containing compounds (e.g., the above-discussed acylated nitrogen-containing compounds (B)) and overbased materials.

The metal salts which are useful with this invention include those salts containing Group IA, IIA or IIB metals, aluminum, lead, tin, iron, molybdenum, manganese, cobalt, nickel or bismuth. Zinc is an especially useful metal. These salts can be neutral salts or basic salts. Examples of useful metal salts of phosphorus-containing acids, and methods for preparing such salts are found in the prior art such as U.S. Pat. Nos. 4,263,150, 4,289,635; 4,308,154; 4,322,479; 4,417,990; and 4,466,895, and the disclosures of these patents are hereby incorporated by reference. These salts include the Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

The following examples illustrate the preparation of useful metal salts of the phosphorus compounds (C).

EXAMPLE C-1

A phosphorodithioic acid is prepared by reactiong finely powdered phosphorus pentasulfide (4.37 moles) with an alcohol mixture containing 11.53 moles of isopropyl alcohol and 7.69 moles of isooctanol. The phosphorodithioic acid obtained in this manner has an acid number of about 178–186 and contains 10.0% phosphorus and 21.0% sulfur. This phosphorodithioic acid is then reacted with an oil slurry of zinc oxide. The quantity of zinc oxide included in the oil slurry is 1.10 times the theoretical equivalent of the acid number of the phosphorodithioic acid. The oil solution of the zinc salt prepared in this manner contains 12% oil, 8.6% phosphorus, 18.5% sulfur and 9.5% zinc.

EXAMPLE C-2

(a) A phosphorodithioic acid is prepared by reactlong a mixture of 1560 parts (12 moles) of isooctyl alcohol and 180 parts (3 moles) of isopropyl alcohol with 756 parts (3.4 moles) of phosphorus pentasulfide. The reaction is conducted by heating the alcohol mixture to about 55° C. and thereafter adding the phosphorus pentasulfide over a period of 1.5 hours while maintaining the reaction temperature at about 60°–75° C. After all of the phosphorus pentasulfide is added, the mixture is heated and stirred for an additional hour at 70°–75° C., and thereafter filtered through filter aid.

(b) Zinc oxide (282 parts, 6.87 moles) is charged to a reactor with 278 parts of mineral oil. The phosphorodithioic acid prepared in (a) (2305 parts, 6.28 moles) is charged to the zinc oxide slurry over a period of 30 minutes with an exotherm to 60° C. The mixture then is heated to 80° C. and maintained at this temperature for 3 hours. After stripping to 100° C. and 6 mm Hg, the mixture is filtered twice through filter aid, and the filtrate is the desired oil solution of the zinc salt containing 10% oil, 7.97% zinc; 7.21% phosphorus; and 15.64% sulfur.

EXAMPLE C-3

(a) Isopropyl alcohol (396 parts, 6.6 moles) and 1287 parts (9.9 moles) of isooctyl alcohol are charged to a reactor and heated with stirring to 59° C. Phosphorus pentasulfide (833 parts, 3.75 moles) is then added under a nitrogen sweep. The addition of the phosphorus pentasulfide is completed in about 2 hours at a reaction temperature between 59°–63° C. The mixture then is stirred at 45°–63° C. for about 1.45 hours and filtered. The filtrate is the desired phosphorodithioic acid.

(b) A reactor is charged with 312 parts (7.7 equivalents) of zinc oxide and 580 parts of mineral oil. While stirring at room temperature, the phosphorodithioic acid prepared in (a) (2287 parts, 6.97 equivalents) is added over a period of about 1.26 hours with an exotherm to 54° C. The mixture is heated to 78° C. and maintained at 78°–85° C. for 3 hours. The reaction mixture is vacuum stripped to 100° C. at 20 mm Hg. The residue is filtered through filter aid, and the filtrate is an oil solution (19.2% oil) of the desired zinc salt containing 7.86% zinc, 7.76% phosphorus and 14.8% sulfur.

EXAMPLE C-4

The general procedure of Example B-6 is repeated except that the mole ratio of isopropyl alcohol to isooctyl alcohol is 1:1. The product obtained in this manner is an oil solution (10% oil) of the zinc phosphorodithiate containing 8.96% zinc, 8.49% phosphorus and 18.05% sulfur.

EXAMPLE C-5

(a) A mixture of 420 parts (7 moles) of isopropyl alcohol and 518 parts (7 moles) of n-butyl alcohol is prepared and heated to 60° C. under a nitrogen atmosphere. Phosphorus pentasulfide (647 parts, 2.91 moles) is added over a period of one hour while maintaining the temperature at 65°–77° C. The mixture is stirred an additional hour while cooling. The material is filtered through filter aid, and the filtrate is the desired phosphorodithioic acid.

(b) A mixture of 113 parts (2.76 equivalents) of zinc oxide and 82 parts of mineral oil is prepared and 662 parts of the phosphorodithioic thioic acid prepared in (a) are added over a period of 20 minutes. The reaction is exothermic and the temperature of the mixture reaches 70° C. The mixture then is heated to 90° C. and maintained at this temperature for 3 hours. The reaction mixture is stripped to 105° C. and 20 mm. Hg. The residue is filtered through filter aid, and the filtrate is the desired product containing 10.17% phosphorus, 21.0% sulfur and 10.98% zinc.

EXAMPLE C-6

A mixture of 29.3 parts (1.1 equivalents) of ferric oxide and 33 parts of mineral oil is prepared, and 273 parts (1.0 equivalent) of the phosphorodithioic acid prepared in Example B-7(a) are added over a period of 2 hours. The reaction is exothermic during the addition, and the mixture is thereafter stirred an additional 3.5 hours while maintaining the mixture at 70° C. The product is stripped to 105° C./10 mm. Hg. and filtered through filter aid. The filtrate is a black-green liquid containing 4.9% iron and 10.0% phosphorus.

EXAMPLE C-7

A mixture of 239 parts (0.41 mole) of the product of Example A-5(a), 11 parts (0.15 mole) of calcium hydroxide and 10 parts of water is heated to about 80° C. and maintained at this temperature for 6 hours. The product is stripped to 105° C. and 10 mm Hg and filtered through filter aid. The filtrate is a molasses-colored liquid containing 2.19% calcium.

EXAMPLE C-8

(a) A mixture of 317.33 grams (5.28 moles) of 2-propanol and 359.67 grams (3.52 moles) of 4-methyl-2-pentanol is prepared and heated to 60° C. Phosphorus pentasulfide (444.54 grams, 2.0 moles) is added to the alcohol mixture while maintaining the temperature at 60° C. Two moles of hydrogen sulfide are liberated and trapped with a 50% aqueous sodium hydroxide trap. The mixture is heated to and maintained at 70° C. for two hours. The mixture is cooled to room temperature and filtered through diatomaceous earth to yield a liquid green product having an acid number in the range of 193–203.

(b) 89.1 grams (1.1 moles) of ZnO are added to 200 ml of toluene. 566.6 grams (2.0 equivalents based on acid number) of the product from part (a) are added dropwise to the ZnO/toluene mixture. The resulting reaction is exothermic. The reaction mixture is stripped to 70° C. and 20 mm Hg to remove water of reaction, toluene and excess alcohol. The residue is filtered through diatomaceous earth. The filtrate, which is the desired product, is a yellow viscous liquid.

EXAMPLE C-9

137.6 grams of zinc oxide are mixed with 149.9 grams of diluent oil. 17.7 grams of 2-ethylhexanoic acid are added. 1000 grams of a phosphorodithioic acid derived from $P_2S_5$ and 2-ethylhexanol are then added to the mixture. The mixture is allowed to neutralize. It is then flash dried and vacuum stripped. 81.1 grams of triphenyl phosphite are added. The temperature of the mixture is adjusted to 124°–129° C. and maintained at that temperature for three hours. The mixture is cooled to room temperature and filtered using filter aid to provide the desired product.

When the phosphorus compound (C) is an ammonium salt, the salt is considered as being derived from ammonia ($NH_3$) or an ammonia yielding compound such as $NH_4OH$. Other ammonia yielding compounds will readily occur to those skilled in the art.

When the phosphorus compound (C) is an amine salt, the salt may be considered as being derived from amines. Any of the amines discussed above under the subtitle "(B) The Acylated Nitrogen-Containing Compounds" can be used.

The following examples illustrate the preparation of amine or ammonium salts of the phosphorus compounds (C) that can be used with this invention.

EXAMPLE C-10

Phosphorus pentoxide (208 grams, 1.41 moles) is added at 50° C. to 60° C. to hydroxypropyl O,O'-diisobutylphosphorodithioate (prepared by reactiong 280 grams of propylene oxide with 1184 grams of O,O'-diisobutylphosphorodithioic acid at 30° C. to 60° C.). The reaction mixture is heated to 80° C. and held at that temperature for 2 hours. To the acidic reaction mixture there is added a stoichiometrically equivalent amount (384 grams) of a commercial aliphatic primary amine at 30° C. to 60° C. The product is filtered. The filtrate has a phosphorus content of 9.31%, a sulfur content of 11.37%, a nitrogen content of 2.50%, and a base number of 6.9 (bromphenol blue indicator).

EXAMPLE C-11

To 400 parts of O,O'di-(isooctyl) phosphorodithioic acid is added 308 parts of oleylamine (Armeen O-Armak).

EXAMPLE C-12

(a) O,O-di-(2-ethylhexyl) dithiophosphoric acid (354 grams) having an acid number of 154 is introduced into a stainless steel "shaker" type autoclave of 1320 ml capacity having a thermostatically controlled heating jacket. Propylene oxide is admitted until the pressure rises to 170 psig at room temperature, and then the autoclave is sealed and shaken for 4 hours at 50° C. to 100° C. during which time the pressure rises to a maximum of 550 psig. The pressure decreases as the reaction proceeds. The autoclave is cooled to room temperature, the excess propylene oxide is vented and the contents removed. The product (358 grams), a dark liquid having an acid number of 13.4, is substantially O,O-di-(2-ethylhexyl)-S-hydroxyisopropyl dithiophosphate.

(b) Ammonia is blown into the product of part (a) until a substantially neutral product is obtained.

(D) Alkali or Alkaline Earth Metal Salt.

The alkali metal or alkaline earth metal salts (D) are salts of organic sulfur acids, carboxylic acids or phenols. These salts can be neutral or basic. The former contain an amount of metal cation just sufficient to neutralize the acidic groups present in salt anion; the latter contain an excess of metal cation and are often termed overbased, hyperbased or superbased salts.

The sulfur acids are oil-soluble organic sulfur acids such as sulfonic, sulfamic, thiosulfonic, sulfinic, sulfenic, partial ester sulfuric, sulfurous and thiosulfuric acid. Generally they are salts of aliphatic or aromatic sulfonic acids.

The sulfonic acids include the mono- or poly-nuclear aromatic or cycloaliphatic compounds. The sulfonic acids can be represented for the most part by one of the following formulae:

$$R^1(SO_3H)_r \quad \text{(D-I)}$$

$$(R^2)_xT(SO_3H)_y \quad \text{(D-II)}$$

wherein in Formulae (D-I) and (D-II), T is an aromatic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, etc; $R^1$ and $R^2$ are each independently aliphatic groups, $R^1$ contains at least about 15 carbon atoms, the sum of the carbon atoms in $R^2$ and T is at least about 15, and r, x and y are each independently 1 or greater. Specific examples of $R^1$ are groups derived from petrolatum, saturated and unsaturated paraffin wax, and polyolefins, including polymerized $C_2$, $C_3$, $C_4$, $C_5$, $C_6$, etc., olefins containing from about 15 to about 7000 or more carbon atoms. The groups T, $R^1$, and $R^2$ in the above formulae can also contain other inorganic or organic substituents in addition to those enumerated above such as, for example, hydroxy, mercapto, halogen, nitro, amino, nitrous, sulfide, disulfide, etc. The subscript x is generally 1–3, and the subscripts r and y generally have an average value of about 1–4 per molecule.

The following are specific examples of oil-soluble sulfonic acids coming within the scope of Formulae (D-I) and (D-II), and it is to be understood that such examples serve also to illustrate the salts of such sulfonic acids useful in this invention. In other words, for every sulfonic acid enumerated it is intended that the corresponding neutral and basic metal salts thereof are also understood to be illustrated. Such sulfonic acids are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax substituted sulfonic and polysulfonic acids of, e.g., benzene, naphthalene, phenol, diphenyl ether, naphthalene disulfide, diphenylamine, thiophene, alpha-chloronaphthalene, etc.; other substituted sulfonic acids such as alkylbenzene sulfonic acids (where the alkyl group has at least 8 carbons), cetylphenol monosulfide sulfonic acids, dicetylthianthrenedisulfonic acids, dilaurylbetanaphthylsulfonic acids, and alkaryl-sulfonic acids such as dodecylbenzene ("bottoms") sulfonic acids.

The latter are acids derived from benzene which has been alkylated with propylene tetramers or isobutene trimers to introduce 1, 2, 3, or more branched-chain $C_{12}$ substituents on the benzene ring. Dodecybenzene bottoms, principally mixtures of mono- and di-dodecylbenzenes, are available as by-products from the manufacture of household detergents.

Similar products obtained from alkylation bottoms formed during manufacture of linear alkylsulfonates (LAS) are also useful in making the sulfonates used in this invention.

The production of sulfonates from detergent manufacture byproducts is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of neutral and basic sulfonate salts and techniques for making them can be found in the following U.S. Pat. Nos.: 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,097; 2,315,514; 2,319,121; 2,321,022; 2,333,568; 2,333,788; 2,335,259; 2,337,552; 2,347,568; 2,366,027; 2,374,193; 2,383,319; 3,312,618; 3,471,403; 3,488,284; 3,595,790; and 3,798,012. These are hereby incorporated by reference for their disclosures in this regard. Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetraamylene sulfonic acids, polyisobutene sulfonic acids wherein the polyisobutene contains from 20 to 7000 or more carbon atoms, chloro-substituted paraffin wax sulfonic acids, nitro-paraffin wax sulfonic acids, etc; cycloaliphatic sulfonic acids such as petroleum naphthene sulfonic acids, cetyl cyclopentyl sulfonic acids, lauryl cyclohexyl sulfonic acids, bis(di-isobutyl) cyclohexyl sulfonic acids, mono- or poly-wax substituted cyclohexyl sulfonic acids, etc.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A particularly valuable group of petroleum sulfonic acids are the mahogany sulfonic acids (so called because of their reddish-brown color) obtained as a by-product from the manufacture of petroleum white oils by a sulfuric acid process.

The carboxylic acids from which suitable neutral and basic alkali metal and alkaline earth metal salts (D) can be made include aliphatic, cycloaliphatic, and aromatic mono- and polybasic carboxylic acids such as the naphthenic acids, alkyl- or alkenyl-substituted cyclopentanoic acids, alkyl- or alkenyl-substituted cyclohexanoic acids, alkyl- or alkenyl-substituted aromatic carboxylic acids. The aliphatic acids generally contain at least 8 carbon atoms and preferably at least 12 carbon atoms. Usually they have no more than about 400 carbon atoms. Generally, if the aliphatic carbon chain is branched, the acids are more oil-soluble for any given carbon atoms content. The cycloaliphatic and aliphatic carboxylic acids can be saturated or unsaturated. Specific examples include 2-ethylhexanoic acid, alphalinolenic acid, propylenetetramer-substituted maleic acid, behenic acid, isostearic acid, pelargonic acid, capric acid, palmitoleic acid, linoleic acid, lauric acid, oleic acid, ricinoleic acid, undecanoic acid, dioctylcyclopentane carboxylic acid, myristic acid, dilauryldecahydronaphthalene carboxylic acid, stearyloctahydroindene carboxylic acid, palmitic acid, and commercially available mixtures of two or more carboxylic acids such as tall oil acids, rosin acids, and the like.

A useful group of oil-soluble carboxylic acids useful in preparing the salts used in the present invention are the oil-soluble aromatic carboxylic acids. These acids are represented by the formula:

$$(R^*)_a—Ar^*(CXXH)_m \qquad \text{(D-III)}$$

wherein in Formula (D-III), R* is an aliphatic hydrocarbon-based group of at least 4 carbon atoms, and no more than about 400 aliphatic carbon atoms, a is an integer of from one to four, Ar* is a polyvalent aromatic hydrocarbon nucleus of up to about 14 carbon atoms, each X is independently a sulfur or oxygen atom, and m is an integer of from one to four with the proviso that R* and a are such that there is an average of at least 8 aliphatic carbon atoms provided by the R* groups for each acid molecule represented by Formula III. Examples of aromatic nuclei represented by the variable Ar* are the polyvalent aromatic radicals derived from benzene, naphthalene, anthracene, phenanthrene, indene, fluorene, biphenyl, and the like. Generally, the group represented by Ar* will be a polyvalent nucleus derived from benzene or naphthalene such as phenylenes and naphthylene, e.g., methylphenylenes, ethoxyphenylenes, nitrophenylenes, isopropylphenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, etc.

The R* groups in Formula (D-III) are usually purely hydrocarbyl groups, preferably groups such as alkyl or alkenyl radicals. However, the R* groups can contain small number substituents such as phenyl, cycloalkyl (e.g., cyclohexyl, cyclopentyl, etc.) and nonhydrocarbon groups such as nitro, amino, halo (e.g., chloro, bromo, etc.), lower alkoxy, lower alkyl mercapto, oxo substituents (i.e., =O), thio groups (i.e., =S), interrupting groups such as —NH, —O—, —S—, and the like provided the essentially hydrocarbon character of the R* group is retained. The hydrocarbon character is retained for purposes of this invention so long as any non-carbon atoms present in the R* groups do not account for more than about 10% of the total weight of the R* groups.

Examples of R* groups include butyl, isobutyl, pentyl, octyl, nonyl, dodecyl, docosyl, tetracontyl, 5-chlorohexyl, 4-ethoxypentyl, hexenyl, e-cyclohexyloctyl, 4-(p-chlorophenyl)-octyl, 2,3,5-trimethylheptyl, 2-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, and the like. Likewise, the group Ar may contain non-hydrocarbon substituents, for example, such diverse substituents as lower alkoxy, lower alkyl mercapto, nitro, halo, alkyl or alkenyl groups of less than 4 carbon atoms, hydroxy, mercapto, and the like.

A group of useful carboxylic acids are those of the formula:

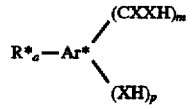

(D-IV)

wherein in Formula (D-IV), R*, X, Ar*, m and a are as defined in Formula (D-III) and p is an integer of 1 to 4, usually 1 or 2. Within this group, a useful class of oil-soluble carboxylic acids are those of the formula:

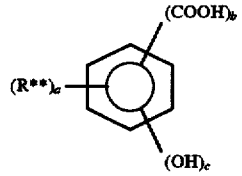

(D-V)

wherein in Formula (D-V), R in Formula (D-V) is an aliphatic hydrocarbon group containing at least 4 to about 400 carbon atoms, a is an integer of from 1 to 3, b is 1 or 2, c is zero, 1, or 2 and preferably 1 with the proviso that R and a are such that the acid molecules contain at least an average of about 12 aliphatic carbon atoms in the aliphatic hydrocarbon substituents per acid molecule. And within this latter group of oil-soluble carboxylic acids, the aliphatic-hydrocarbon substituted salicylic acids wherein each aliphatic hydrocarbon substituent contains an average of at least about 16 carbon atoms per substituent and one to three substituents per molecule are particularly useful. Salts prepared from such salicylic acids wherein the aliphatic hydrocarbon substituents are derived from polymerized olefins, particularly polymerized lower 1 -mono-olefins such as polyethylene, polypropylene, polyisobutylene, ethylene/propylene copolymers and the like and having average carbon contents of about 30 to 400 carbon atoms.

The carboxylic acids corresponding to Formulae (D-III) and (D-IV) above are well known or can be prepared according to procedures known in the art. Carboxylic acids of the type illustrated by the above formulae and processes for preparing their neutral and basic metal salts are well known and disclosed, for example, in such U.S. Pat. Nos. as 2,197,832; 2,197,835; 2,252,662; 2,252,664; 2,714,092; 3,410,798 and 3,595,791.

Another type of neutral and basic carboxylate salt used in this invention are those derived from alkenyl succinic acids of the general formula

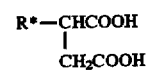

(D-VI)

wherein in Formula (D-VI), R* is as defined above in Formula (D-III). Such salts and means for making them are set forth in U.S. Pat. Nos. 3,271,130; 3,567,637 and 3,632,610, which are hereby incorporated by reference in this regard.

Other patents specifically describing techniques for making basic salts of the hereinabove-described sulfonic acids, carboxylic acids, and mixtures of any two or more of these include U.S. Pat. Nos. 2,501,731; 2,616,904; 2,616,905; 2,616,906; 2,616,911; 2,616,924; 2,616,925; 2,617,049, 2,777,874; 3,027,325; 3,256,186; 3,282,835; 3,384,585; 3,373,108; 3,368,396; 3,342,733; 3,320,162; 3,312,618; 3,318,809; 3,471,403; 3,488,284; 3,595,790; and 3,629,109. The disclosures of these patents are hereby incorporated in this present specification for their disclosure in this regard as well as for their disclosure of specific suitable basic metal salts.

Neutral and basic salts of phenols (generally known as phenates) are also useful in the compositions of this invention and well known to those skilled in the art. The phenols from which these phenates are formed are of the general formula

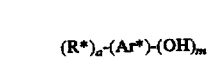

(D-VII)

wherein in Formula (D-VII), R*, a, Ar*, and m have the same meaning and preferences as described hereinabove with reference to Formula (D-III). The same examples described with respect to Formula (D-III) also apply.

The commonly available class of phenates are those made from phenols of the general formula

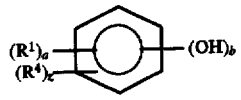

(D-VIII)

wherein in Formula (D-VIII), a is an integer of 1–3, b is of 1 or 2, z is 0 or 1, $R^1$ is a substantially saturated hydrocarbon-based substituent having an average of from about 30 to about 400 aliphatic carbon atoms and $R^4$ is selected from the group consisting of lower alkyl, lower alkoxyl, nitro, and halo groups.

One particular class of phenates for use in this invention are the basic (i.e., overbased, etc.) alkali and alkaline earth metal sulfurized phenates made by sulfurizing a phenol as described hereinabove with a sulfurizing agent such as sulfur, a sulfur halide, or sulfide or hydrosulfide salt. Techniques for making these sulfurized phenates are described in U.S. Pat. Nos. 2,680,096; 3,036,971 and 3,775,321 which are hereby incorporated by reference for their disclosures in this regard.

Other phenates that are useful are those that are made from phenols that have been linked through alkaline (e.g., methylene) bridges. These are made by reactiong single or multi-ring phenols with aldehydes or ketones, typically, in the presence of an acid or basic catalyst. Such linked phenates as well as sulfurized phenates are described in detail in U.S. Pat. No. 3,350,038; particularly columns 6–8 thereof, which is hereby incorporated by reference for its disclosures in this regard.

Mixtures of two or more neutral and basic salts of the hereinabove described organic sulfur acids, carboxylic acids and phenols can be used in the compositions of this invention.

The alkali and alkaline earth metals that are preferred include sodium, potassium, lithium, calcium, magnesium, strontium and barium, with calcium, sodium, magnesium and barium being especially useful.

The following examples illustrate the preparation of alkali or alkaline earth metal salts (D) that are useful with this invention.

EXAMPLE D-1

A mixture of 1000 grams of a primarily branched chain monoalkyl benzenesulfonic acid (n=500), 771 grams of o-xylene, and 75.2 grams of polyisobutenyl (number average n=950) succinic anhydride is prepared and the temperature is adjusted to 46° C. 87.3 grams of magnesium oxide are added. 35.8 grams of acetic acid are added. 31.4 grams of methyl alcohol and 59 grams of water are added. The reaction mixture is blown with 77.3 grams of carbon dioxide at a temperature of 49°–54° C. 87.3 grams of magnesium oxide, 31.4 grams of methyl alcohol and 59 grams of water are added, and the reaction mixture is blown with 77.3 grams of carbon dioxide at 49°–54° C. The foregoing steps of magnesium oxide, methyl alcohol and water addition, followed by carbon dioxide blowing are repeated once. O-xylene, methyl alcohol and water are removed from the reaction mixture using atmospheric and vacuum flash stripping. The reaction mixture is cooled and filtered to clarity. The product is an overbased magnesium sulfonate having a base number (bromophenol blue) of 400, a metal content of 9.4% by weight, a metal ratio of 14.7, a sulfate ash content of 46.0%, and a sulfur content of 1.6% by weight.

EXAMPLE D-2

110 parts by weight of an amyl alcohol-isobutyl alcohol mixture, 3.6 parts by weight of a calcium chloride-methanol mixture (96% by weight $CaCl_2$), 7.7 parts by weight of water and 49.2 parts by weight of calcium hydroxide are mixed together. 1000 parts by weight of an oil solution of polypropylene (n=500) substituted benzenesulfonic acid are added to the mixture while maintaining the temperature of the resulting mixture below 77° C. The mixture is heated to 85°–88° C. and maintained at that temperature for two hours. The mixture is stripped at a temperature of 149° C. until the water content is less than 0.5% by weight. The mixture is then cooled and filtered. Diluent oil is added to provide a calcium content of 2.5% by weight.

EXAMPLE D-3

(a) 1000 grams of sodium alkylarylsulfonate and 20 grams of diluent oil are blended and heated to 93°–99° C. 71.3 grams of Peladow (a product of Dow Chemical identified as 96% $CaCl_2$ solution) and 84 grams of water are added to the mixture. The mixture is stirred for 15 minutes. 67 grams of hydrated lime are added and the mixture is stirred for 15 minutes. The mixture is kettle dried to 146° C., cooled to room temperature, and adjusted to a water content of 0.7% by weight. 130 grams of methyl alcohol are added. The mixture is carbonated to a base number of 6–10 at a temperature of 43°–52° C. using 33 grams of $CO_2$, and then flash stripped at 146°–154° C. The mixture is filtered and the oil content is adjusted to 50% by weight.

(b) 1000 grams of the product from part (a) and 52.6 grams of the of the reaction product of heptylphenol, lime and formaldehyde are mixed and heated to 60° C. 1.7 grams of Peladow and 88.4 grams of an alcohol mixture (65% isobutyl alcohol, 22% 1-pentanol and 13% 2-methyl-1-butanol) are added to the mixture. 190 grams of hydrated lime are added to the mixture and the temperature is adjusted to 46°–53° C. The mixture is blown using $CO_2$ until a total base number in the range of 40–50 is achieved. 190 grams of hydrated lime are added to the mixture and the mixture is blown using $CO_2$ until a total base number of 35–45 is achieved. The mixture is clarified and the oil content is adjusted to a concentration of 53% by weight.

EXAMPLE D-4

A mixture of 1251 parts by weight of kerosene, 1000 parts by weight of polyisobutenyl (Mn=940) succinic anhydride, 159 parts by weight of $C_{12}$ alkylphenol, and 0.052 parts by weight of a silicone antifoam agent is prepared and heated to 48.8° C. 187 parts by weight of a 50% aqueous NaOH solution are added. The mixture is heated to 65.6°–71.1° C. and maintained at that temperature for two hours. 525 parts by weight of solid NaOH are added. The mixture is heated to 132°–143° C. to remove water under kerosene reflux. The mixture is carbonated using liquid $CO_2$ to achieve a base number of less than 1.0. The mixture is cooled to 82.2° C. 525 parts by weight of solid NaOH are added and the mixture is heated to 132° C. The mixture is carbonated using liquid $CO_2$ at 132°–143° C. to a base number of less than 1.0 while removing water under kerosene reflux. The mixture is heated to 148.9° C. and maintained at that temperature until the water content is reduced to 0.5% by weight. The mixture is flash stripped at 160° C. and 70 mm Hg to remove kerosene. Diluent oil is added to provide the mixture with an oil content of 49% by weight.

EXAMPLE D-5

(a) 1000 parts by weight of $C_{12}$ alkylphenol are heated to 54.4° C. 175 parts by weight of sulfur dichloride are added at a rate such that the temperature of the resulting reaction mixture does not exceed 65.5° C. The mixture is then heated to 76.7°–82.2° C. until the acid number of the mixture is less than 4.0. Diluent oil is added to provide the mixture with an oil content of 27% by weight.

(b) 1000 parts by weight of the product from part (a) and 100 parts by weight of diluent oil are blended and heated to 50° C. 370 parts by weight of methanol, 25.5 parts by weight of acetic acid and 51 parts by weight of calcium hydroxide are added with stirring. The mixture is blown with $CO_2$ at a rate of 1 cubic foot per hour (cfh) for 1.75 hours while maintaining the temperature at 50°–55° C. The mixture is then stripped to 160° C. using nitrogen blowing at a rate of 1.5 cfh. The mixture is cooled to room temperature and allowed to stand overnight. The mixture is then heated to 100° C. 102 parts by weight of polyisobutenyl (Mn=940) succinic anhydride are added and the resulting mixture is heated to 150° C. and maintained at that temperature for one hour. The oil content of the resulting product is adjusted to 38% by weight.

(E) Thiocarbamate.

Component (E) is a thiocarbamate which can be represented by the formula $$R^1\ R^2N—C(X)S—(CR^3R^4)_aZ \qquad \text{(E-I)}$$

wherein in Formula (E-I), $R^1$, $R^2$, $R^3$ and $R^4$ are independently hydrogen or hydrocarbyl groups, provided that at least one of $R^1$ or $R^2$ is a hydrocarbyl group; X is O or S; a is zero, 1 or 2; and Z is a hydrocarbyl group, a hetero group (that is, a group attached through a hetero atom such as O, N, or S), a hydroxy hydrocarbyl group, an activating group, or a group represented by the formula $—(S)_bC(X)—NR^1R^2$ wherein b is zero, 1 or 2 and X is O or S. When a is zero, Z can be an ammonium, amine or metal cation.

When a is 2, Z is an activating group. In describing Z as an "activating group," what is meant is a group which will activate an olefin to which it is attached toward nucleophilic addition by, e.g., $CS_2$ or COS derived intermediates. (This is reflective of a method by which this material can be prepared, by reaction of an activated olefin with $CS_2$ and an amine.) The activating group Z can be, for instance, an ester group, typically but not necessarily a carboxylic ester group of the structure $—COOR^5$. It can also be an ester group based on a non-carbon acid, such as a sulfonic or sulfinic ester or a phosphonic or phosphinic ester. The activating group can also be any of the acids corresponding to the aforementioned esters. Z can also be an amide group, that is, based on the condensation of an acid group, preferably a carboxylic acid group, with an amine. In that case the $—(CR^3R^4)_aZ$ group can be derived from acrylamide. Z can also be an ether group, $—OR^5$; a carbonyl group, that is, an aldehyde or a ketone group; a cyano group, —CN, or an aryl group. In one embodiment Z is an ester group of the structure, $—COOR^5$, where $R^5$ is a hydrocarbyl group. $R^5$ can comprise 1 to about 18 carbon atoms, and in one embodiment 1 to about 6 carbon atoms. In one embodiment $R^5$ is methyl so that the activating group is $—COOCH_3$.

When a is 1, Z need not be an activating group, because the molecule is generally prepared by methods, described below, which do not involve nucleophilic addition to an activated double bond.

When Z is a hydrocarbyl or a hydroxy hydrocarbyl group, a can be zero, 1 or 2. These hydrocarbyl groups can have from 1 to about 30 carbon atoms, and in one embodiment 1 to about 18 carbon atoms, and in one embodiment 1 to about 12 carbon atoms. Examples include methyl, ethyl, propyl, n-butyl, isobutyl, pentyl, isopentyl, heptyl, octyl, 2-ethylhexyl, nonyl, decyl, dodecyl, and the corresponding hydroxy-substituted hydrocarbyl groups such as hydroxymethyl, hydroxyethyl, hydroxypropyl, etc.

When a is zero, Z can be an ammonium, amine or metal cation. Thus the thiocarbamate (E), in one embodiment, can be represented by one of the formulae $$R^1R^2N—C(X)S^-NH_4 \quad \text{(E-II)}$$

$$R^1R^2N—C(X)S^-\overset{\overset{H}{|}}{\underset{\underset{R^5}{|}}{N}}\begin{matrix}R^3\\R^4\end{matrix} \quad \text{(E-III)}$$

$$[R^1R^2—N—C(X)S—]_nM^n \quad \text{(E-IV)}$$

In Formulae (E-II), (E-III) and (E-IV), $R^1$, $R^2$ and X have the same meaning as in Formula (E-I). $R^3$, $R^4$ and $R^5$ are independently hydrogen or hydrocarbyl groups of 1 to about 30 carbon atoms. M is a metal cation and n is the valence of M.

When the thiocarbamate (E) is an ammonium salt (Formula (E-II)), the salt is considered as being derived from ammonia ($NH_3$) or an ammonia yielding compound such as $NH_4OH$. Other ammonia yielding compounds will readily occur to those skilled in the art.

When the thiocarbamate (E) is an amine salt (Formula (E-III)), the salt may be considered as being derived from amines. The amines may be primary, secondary or tertiary amines, or mixtures thereof. Hydrocarbyl groups of the amines may be aliphatic, cycloaliphatic or aromatic. These include alkyl and alkenyl groups. In one embodiment the amine is an alkylamine wherein the alkyl group contains from 1 to about 24 carbon atoms. Any of the amines described above for making the phosphorus compound amine salts (C) can be used for making these thiocarbamate amine salts.

When the thiocarbamate (E) is a metal salt (Formula (E-IV)), M can be a Group IA, IIA or IIB metal, aluminum, lead, tin, iron, molybdenum, manganese, cobalt, nickel or bismuth. Zinc is an especially useful metal. Mixtures of two or more of these metals can be used. These salts can be neutral salts as shown in Formula (E-IV) or they can be basic salts wherein a stoichiometric excess of the metal is present.

$R^3$ and $R^4$ can be, independently, hydrogen or methyl or ethyl groups. When a is 2, at least one of $R^3$ and $R^4$ is normally hydrogen so that this compound will be $R^1R^2N—C(S)S—CR^3HCR^3R^4COOR^5$. In one embodiment the thiocarbamate is $R^1R^2N—C(S)S—CH_2CH_2COOCH_3$. (These materials can be derived from methyl methacrylate and methyl acrylate, respectively.) These and other materials containing appropriate activating groups are disclosed in greater detail in U.S. Pat. No. 4,758,362, which is incorporated herein by reference.

The substituents $R^1$ and $R^2$ on the nitrogen atom are likewise hydrogen or hydrocarbyl groups, but at least one should be a hydrocarbyl group. It is generally believed that at least one such hydrocarbyl group is desired in order to provide a measure of oil-solubility to the molecule. However, $R^1$ and $R^2$ can both be hydrogen, provided the other R groups in the molecule provide sufficient oil solubility to the molecule. In practice this means that at least one of the groups $R^3$ or $R^4$ should be a hydrocarbyl group of at least 4 carbon atoms. In one embodiment, $R^1$ and $R^2$ can be independently hydrocarbyl groups (e.g., aliphatic hydrocarbyl groups such as alkyl groups) of 1 to about 50 carbon atoms, and in one embodiment 1 to about 30 carbon atoms, and in one embodiment 1 to about 18 carbon atoms, and in one embodiment 1 to about 12 carbon atoms, and in one embodiment 1 to about 8 carbon atoms.

In one embodiment the thiocarbamate is a compound represented by the formula $$R^1R^2N—\overset{\overset{S}{\|}}{C}—S—CH_2CH_2—\overset{\overset{O}{\|}}{C}—OR^5 \quad \text{(E-V)}$$

wherein in Formula (E-V) $R^1$, $R^2$ and $R^5$ are independently hydrocarbyl (e.g., alkyl) groups. These hydrocarbyl groups can have from 1 to about 18 carbon atoms, and in one embodiment 1 to about 12 carbon atoms, and in one embodiment 1 to about 8 carbon atoms, and in one embodiment 1 to about 4 carbon atoms. These compounds include S-carbomethoxyethyl-N,N-dibutyl dithiocarbamate which can be represented by the formula $$\begin{matrix}C_4H_9\\C_4H_9\end{matrix}\!\!>N—\overset{\overset{S}{\|}}{C}—S—CH_2CH_2\overset{\overset{O}{\|}}{C}—OCH_3 \quad \text{(E-VI)}$$

Materials of this type can be prepared by a process described in U.S. Pat. No. 4,758,362. Briefly, these materials are prepared by reactiong an amine, carbon disulfide or carbonyl sulfide, or source materials for these reactants, and a reactant containing an activated, ethylenically-unsaturated bond or derivatives thereof. These reactants are charged to a reactor and stirred, generally without heating, since the reaction is normally exothermic. Once the reaction reaches the temperature of the exotherm (typically 40°–65° C.), the reaction mixture is held at the temperature to insure complete reaction. After a reaction time of typically 3–5 hours, the volatile materials are removed under reduced pressure and the residue is filtered to yield the final product.

The relative amounts of the reactants used to prepare these compounds are not critical. The charge ratios to the reactor can vary where economics and the amount of the product desired are controlling factors. Thus, the molar charge ratio of the amine to the $CS_2$ or COS reactant to the ethylenically unsaturated reactant may vary in the ranges 5:1:1 to 1:5:1 to 1:1:5. In one embodiment, the charge ratios of these reactants is 1:1:1.

In the case where a is 1, the activating group Z is separated from the sulfur atom by a methylene group. Materials of this type can be prepared by reaction of sodium dithiocarbamate with a chlorine-substituted material. Such materials are described in greater detail in U.S. Pat. No. 2,897,152, which is incorporated herein by reference.

In one embodiment, a is zero, and Z is $—C(S)—NR^1R^2$, $—SC(S)—NR^1R^2$ or $—SSC(S)—NR^1R^2$. These compounds can be referred to as mono-, di- and trisulfides, respectively. These are known compounds which can be prepared using known procedures. For example, the disulfides can be made by oxidizing a thiocarbamate to form the desired disulfide. Examples of useful oxidizing agents that can be used include hydrogen peroxide, cobalt maleonitriledithioate, $K_2Fe(CN)_6$, $FeCl_3$, dimethylsulfoxide, dithiobis(thio formate), copper sulfate, etc.

In one embodiment the thiocarbamate (E) is a disulfide represented by the formula $$R^1R^2N—\overset{\overset{X}{\|}}{C}S—\overset{\overset{X}{\|}}{S}C—NR^1R^2 \quad \text{(E-VII)}$$

wherein in Formula (E-VII), $R^1$ and $R^2$ are independently hydrocarbyl groups, and X is O or S, and in one embodiment X is S. These include compounds represented by the formula $$R^1R^2N-\overset{\overset{\displaystyle S}{\|}}{C}S-S\overset{\overset{\displaystyle S}{\|}}{C}-NR^1R^2 \quad \text{(E-VIII)}$$

wherein in Formula (E-VII) and (E-VIII), $R^1$ and $R^2$ are independently hydrocarbyl groups including aliphatic hydrocarbyl groups such as alkyl groups. These hydrocarbyl groups may be linear (straight chain) or branched chain and can have 1 to about 50 carbon atoms, and in one embodiment 1 to about 30 carbon atoms, and in one embodiment 1 to about 18 carbon atoms, and in one embodiment 1 to about 12 carbon atoms, and in one embodiment 1 to about 8 carbon atoms. Typical hydrocarbyl groups include, for example, methyl, ethyl, propyl, n-butyl, isobutyl, pentyl, isopentyl, heptyl, octyl, 2-ethylhexyl, nonyl, decyl, and dodecyl. Typical examples of the thiocarbamate disulfide compounds include bis(dimethylthiocarbamoyl)disulfide, bis(dibutylthiocarbamoyl)disulfide, bis(diamylthiocarbamoyl)disulfide, bis(dioctylthiocarbamoyl)disulfide, etc.

The following examples illustrate the preparation of thiocarbamates (E) that can be used with this invention.

EXAMPLE E-1

Carbon disulfide (79.8 grams, 1.05 moles) and methyl acrylate (86 grams, 1.0 mole) are placed in a reactor and stirred at room temperature. Di-n-butylamine (129 grams, 1.0 mole) is added dropwise to the mixture. The resulting reaction is exothermic, and the di-n-butylamine addition is done at a sufficient rate to maintain the temperature at 55° C. After the addition of di-n-butyl amine is complete, the reaction mixture is maintained at 55° C. for four hours. The mixture is blown with nitrogen at 85° C. for one hour to remove unreacted starting material. The reaction mixture is filtered through filter paper, and the resulting product is a viscous orange liquid.

EXAMPLE E-2

Di-n-butylamine (129 grams, 1 equivalent) is charged to a reactor. Carbon disulfide (84 grams, 1.1 equivalents) is added dropwise over a period of 2.5 hours. The resulting reaction is exothermic but the temperature of the reaction mixture is maintained below 50° C. using an ice bath. After the addition of carbon disulfide is complete the mixture is maintained at room temperature for one hour with stirring. A 50% aqueous sodium hydroxide solution (40 grams), is added and the resulting mixture is stirred for one hour. A 30% aqueous hydrogen peroxide solution (200 grams), is added dropwise. The resulting reaction is exothermic but the temperature of the reaction mixture is maintained below 50° C. using an ice bath. The mixture is transferred to a separatory funnel. Toluene (800 grams) is added to the mixture. The organic layer is separated from the product and washed with one liter of distilled water. The separated and washed organic layer is dried over sodium carbonate and filtered through diatomaceous earth. The mixture is stripped on a rotary evaporator at 77° C. and 20 mm Hg to provide the desired dithiocarbamate disulfide product which is in the form of a dark orange liquid.

(F) Organic Sulfide

The organic sulfides (F) that are useful with this invention are compounds represented by the formula $$T^1-\overset{\overset{\displaystyle X^1}{\|}}{C}-S-(S)_n-\overset{\overset{\displaystyle X^2}{\|}}{C}-T^2 \quad \text{(F-I)}$$

wherein in Formula (F-1), $T^1$ and $T^2$ are independently R, OR, SR or NRR wherein each R is independently a hydrocarbyl group, $X^1$ and $X^2$ are independently O or S, and n is zero to 3. In one embodiment, $X^1$ and $X^2$ are each S. In one embodiment, n is 1 to 3, and in one embodiment, n is 1.

Thus, compounds represented by the formula $$T^1-\overset{\overset{\displaystyle S}{\|}}{C}-S-S-\overset{\overset{\displaystyle S}{\|}}{C}-T^2 \quad \text{(F-II)}$$

wherein in Formula (F-2), $T^1$ and $T^2$ are as defined above can be used. In one embodiment, each R is a hydrocarbyl group of 1 to about 50 carbon atoms, and in one embodiment 1 to about 40 carbon atoms, and in one embodiment 1 to about 30 carbon atoms, and in one embodiment 1 to about 20 carbon atoms. In one embodiment, each R is independently methyl, ethyl, propyl, isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthly, phenylalkyl, naphthylalkyl, alkylphenylalkyl or alkylnaphthylalkyl.

In one embodiment, the organic sulfide is a compound represented by the formula:

$$R-\overset{\overset{\displaystyle O}{\|}}{C}-S-(S)_n-\overset{\overset{\displaystyle O}{\|}}{C}-R \quad \text{(F-III)}$$

wherein in Formula (F-3), R and n are as defined above, with compoiunds wherein n is 1 being especially useful.

In one embodiment, the organic sulfide is a compound represented by the formula $$RO-\overset{\overset{\displaystyle S}{\|}}{C}-S-(S)_n-\overset{\overset{\displaystyle S}{\|}}{C}-OR \quad \text{(F-IV)}$$

wherein in Formula (F-4), R and n are as defined above, with compounds wherein n is 1 being useful.

In one embodiment, the organic sulfide is a compound represented by the formula $$RS-\overset{\overset{\displaystyle S}{\|}}{C}-S-(S)_n-\overset{\overset{\displaystyle S}{\|}}{C}-SR \quad \text{(F-V)}$$

wherein in Formula (F-5), R and n are defined above, with compounds wherein n is 1 being especially useful.

In one embodiment, the organic sulfide is a compound represented by the formula $$RRN-\overset{\overset{\displaystyle S}{\|}}{C}-S-(S)_n-\overset{\overset{\displaystyle S}{\|}}{C}-NRR \quad \text{(F-VI)}$$

wherein in Formula (F-VI), R and n are as defined above, with compounds wherein n is 1 being especially useful.

These compounds are known and can be prepared by conventional techniques. For example, an appropriate mercaptan, alcohol or amine can first be reacted with an alkali metal reagent (e.g., NaOH, KOH) and carbon disulfide to form the corresponding thiocarbonate or dithiocarbamate. The thiocarbonate or dithiocarbamate is then reacted with an oxidizing agent (e.g., hydrogen peroxide, cobalt maleonitriledithioate, $K_2Fe(CN)_6$, $FeCl_3$, dimethylsulfoxide, dithiobis(thioformate), copper sulfate, etc.) to form a disulfide, or with sulfur dichloride or sulfur monochloride to form a trisulfide or tetrasulfide, respectively. The oxygen-containing analogs of these compounds wherein $X^1$ and $X^2$ in Formula (F-1) are oxygen can be prepared by treating the sulfur-containing compounds with water or steam.

Alcohols used to prepare the organic sulfides of Formula (F-I) can be any of those described above under the subtitle "(C) Phosphorus Compound."

The amines that can be used include those described above under the subtitle "(B) Acylated Nitrogen-Containing Compounds."

Mercaptans that can be used include those described above under the subtitle "(A) Thiocarbonates."

The following examples illustrate the preparation of organic sulfices (F) that are useful with this invention.

EXAMPLE F-1

Di-n-butylamine (129 grams, 1 equivalent) is charged to a reactor. Carbon disulfide (84.0 grams, 1.1 equivalents) is added dropwise over a period of 2.5 hours. The resulting reaction is exothermic but the temperature of the reaction mixture is maintained below 50° C. using an ice bath. After the addition of carbon disulfide is complete the mixture is maintained at room temperature for one hour with stirring. A 50% aqueous sodium hydroxide solution (80 grams) is added and the resulting mixture is stirred for one hour. A 30% aqueous hydrogen peroxide solution (200 grams) is added dropwise. The resulting reaction is exothermic but the temperature of the reaction mixture is maintained below 50° C. using an ice bath. The mixture is transferred to a separatory funnel. Toluene (800 grams) is added to the mixture. The organic layer is separated from the product and washed with one liter of distilled water. The separated and washed organic layer is dried over sodium carbonate and filtered through diatomaceous earth. The mixture is stripped on a rotary evaporator at 77° C. and 20 mm Hg to provide the desired dithiocarbamate disulfide product which is in the form of a dark orange liquid.

EXAMPLE F-2

Di-n-butyl amine (1350 grams) is charged to a reactor. Carbon disulfide (875 grams) is added dropwise while maintaining the mixture below 50° C. A 50% aqueous sodium hydroxide solution (838 grams) is added dropwise. A 30% aqueous $H_2O_2$ solution (2094 grams) is added dropwise. The reaction mixture exotherms. An aqueous layer and an organic layer form. The aqueous layer is separated from the organic layer. Diethyl ether (1000 grams) is mixed with the aqueous layer to extract organic material from it. The diethyl ether containing extract is added to the organic layer. The resulting mixture is stripped at 70° C. and 20 mm Hg, and then filtered through diatomaceous earth to provide the desired disulfide product which is in the form of a brown liquid.

EXAMPLE F-3

A mixture of 1-octanethiol (200 grams), 50% aqueous NaOH solution (110 grams) and toluene (200 grams) is prepared and heated to reflux (120° C.) to remove water. The mixture is cooled to room temperature and carbon disulfide (114.5 grams) is added. A 30% aqueous $H_2O_2$ solution (103 grams) is added dropwise while maintaining the temperature below 50° C. Diethyl ether is added and then extracted. The organic layer is isolated, washed with distilled water, dried and chromotographed using hexane to provide the desired disulfide product which is in the form of a yellow liquid.

EXAMPLE F-4

(a) A mixture of 4000 grams of dodecyl mercaptan, 1600 grams of a 50% aqueous NaOH solution and 2000 grams of toluene is prepared and heated to 125° C. to remove 1100 grams of water. The reaction mixture is cooled to 40° C. and 1672 grams of carbon disulfide are added. The mixture is heated to 70° C. and maintained at that temperature for 8 hours. The mixture is filtered using diatomaceous earth and stripped at 100° C. and 20 mm Hg to form the desired product which is in the form of a red liquid.

(b) 200 grams of the product from part (a) and 200 grams of hexane are placed in a reactor and cooled to 10° C. 130 grams of a 30% aqueous $H_2O_2$ solution are added dropwise while maintaining the temperature below 45° C. The mixture is extracted with diethyl ether. The organic portion is washed with water, dried with $Na_2CO_3$, filtered, and heated under azeotropic conditions to remove water and provide the desired disulfide product which is in the form of a bright red liquid.

EXAMPLE F-5

1700 grams of methylpentanol and 407 grams of potassium hydroxide are placed in a reactor. The mixture is heated under reflux conditions to remove 130–135 grams of water. The mixture is cooled to 50° C., and 627 grams of carbon disulfide are added. 750 grams of a 30% aqueous $H_2O_2$ solution are added dropwise. the mixture exotherms, and an aqueous layer and an organic layer are formed. The aqueous layer is separated from the organic layer. The organic layer is stripped at 100° C. and 20 mm Hg and filtered to provide the desired disulfide product which is in the form of an orange liquid.

EXAMPLE F-6

1100 grams of methylpentyl alcohol and 863 grams of a 50% aqueous NaOH solution are placed in a reactor and heated to 120° C. to remove 430 grams of water. The mixture is cooled to 50° C. and 925 grams of carbon disulfide are added. 623 grams of a 30% aqueous $H_2O_2$ solution are added dropwise. The resulting reaction is exothermic, and an aqueous and an organic layer are formed. The aqueous layer is separated. The organic layer is stripped at 100° C. and 20 mm Hg and filtered to provide the desired disulfide product.

EXAMPLE F-7

A mixture of isopropyl alcohol (132 grams), methyl pentyl alcohol (330 grams) and a 50% aqueous NaOH solution (435 grams) is prepared. Water (50 grams) is removed using distillation at 70° C. The mixture is cooled to room temperature and carbon disulfide (455 grams) is added. A 30% aqueous $H_2O_2$ solution (1352 grams) is added dropwise while maintaining the temperature below 50° C. Water is removed. The resulting organic layer is stripped at 70° C. and 20 mm Hg to form a paste-like composition. The paste-like composition is filtered to provide the desired disulfide product which is in the form of a red liquid.

Lubricating Compositions, Functional Fluids and Concentrates

The lubricating compositions and functional fluids of the present invention are based on diverse oils of lubricating viscosity, including natural and synthetic lubricating oils and mixtures thereof. The lubricating compositions may be lubricating oils and greases useful in industrial applications and in automotive engines, transmissions and axles. These lubricating compositions are effective in a variety of applications including crankcase lubricating oils for spark-ignited and compression-ignited internal combustion engines, including automobile and truck engines, two-cycle engines, aviation piston engines, marine and low-load diesel engines, and the like. Also, automatic transmission fluids, farm tractor fluids, transaxle lubricants, gear lubricants, metal-working lubricants, hydraulic fluids, and other lubricating oil and grease compositions can benefit from the incorporation of the compositions of this invention. The inventive lubricating compositions are particularly effective as engine lubricating oils having enhanced antiwear properties and improved fuel efficiency properties when used in the crankcase of internal combustion engines.

The lubricant compositions of this invention employ an oil of lubricating viscosity which is generally present in a major amount (i.e. an amount greater than about 50% by weight). Generally, the oil of lubricating viscosity is present in an amount greater than about 60%, or greater than about 70%, or greater than about 80% by weight of the composition.

The natural oils useful in making the inventive lubricants and functional fluids include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils such as polymerized and interpolymerized olefins (e.g., polybutylenes, polypropylenes, propylene-isobutylene copolymers, etc.); poly(1-hexenes), poly-(1-octenes), poly (1-decenes), etc. and mixtures thereof; alkylbenzenes (e.g., dodecylbenzenes, tetradecylbenzenes, dinonylbenzenes, di-(2-ethylhexyl)benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_{3-8}$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexylfumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reactiong one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkylo, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methylhexyl)silicate, tetra-(p-tert-butyl-phenyl) silicate, hexyl-(4-methyl-2-pentoxy) disiloxane, poly(methyl) siloxanes, poly-(methylphenyl) siloxanes, etc.). Other synthetic lubricating oils include liquid esters of phosphorus-containing acids (e.g., tricresyl phosphate, trioctyl phosphate, diethyl ester of decanephosphonic acid, etc.), polymeric tetrahydrofurans and the like.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

In one embodiment, the reaction product (AT) comprising component (A) treated to reduce polysulfide content is employed in the lubricant or functional fluid at a concentration in the range of about 0.001% to about 5% by weight, and in one embodiment about 0.01% to about 3%, and in one embodiment about 0.02% to about 2% by weight based on the total weight of the lubricant or functional fluid. In one embodiment, component (B) is employed in the lubricant or functional fluid at a concentration in the range of about 0.01% to about 20% by weight, and in one embodiment from about 0.1% to about 10%, and in one embodiment from about 0.5% to about 10% by weight based on the total weight of the lubricant or functional fluid. In one embodiment, component (C) is employed in the lubricant or functional fluid at a concentration in the range of up to about 20% by weight, and in one embodiment from about 0.01% to about 10%, and in one embodiment from about 0.05% to about 5% by weight based on the total weight of the lubricant or functional fluid. In one embodiment, component (D) is employed in the lubricant or functional fluid at a concentration in the range of up to about 20% by weight, and in one embodiment from about 0.01% to about 10%, and in one embodiment from about 0.1% to about 5% by weight based on the total weight of the lubricant or functional fluid. In one embodiment, component (E) is employed in the lubricant or functional fluid at a concentration in the range of up to about 10% by weight, and in one embodiment about 0.01% to about 5%, and in one embodiment about 0.1% to about 3% by weight based on the total weight of the lubricant or functional fluid.

The weight ratio of (B):(AT) is, in one embodiment, from about 0.01 to about 100, and in one embodiment about 0.1 to about 50, and in one embodiment from about 0.5 to about 20. The weight ratio of (C):(AT) is, in one embodiment, from about zero to about 100, and in one embodiment from about 0.1 to about 20, and in one embodiment from about 0.1 to about 5. The weight ratio of (D):(AT) is, in one embodiment, from about zero to about 100, and in one embodiment from about 0.01 to about 20, and in one embodiment from about 0.1 to about 10. The weight ratio of (E):(AT) is, in one embodiment, from about zero to about 100, and in one embodiment from zero to about 10, and in one embodiment from zero to about 5. The weight rtio for (F):(AT) is the same as (E):(AT).

In one embodiment these lubricating compositions and functional fluids have a phosphorus content of up to about 0.12% by weight, and in one embodiment up to about 0.11% by weight, and in one embodiment up to about 0.10% by weight, and in one embodiment up to about 0.08% by weight, and in one embodiment up to about 0.05% by weight. In one embodiment the phosphorus content is in the range of about 0.01% to about 0.12% by weight, and in one embodiment about 0.01% to about 0.11% by weight, and in one embodiment about 0.02% to about 0.10% by weight and in one embodiment about 0.05% to about 0.10% by weight.

The invention also provides for the use of lubricants and functional fluids containing other additives in addition to components (AT), (B), (C), (D) and (E). Such additives include, for example, detergents and dispersants, corrosion-inhibiting agents, antioxidants, viscosity improving agents, extreme pressure (E.P.) agents, pour point depressants, friction modifiers, fluidity modifiers, anti-foam agents, etc.

The inventive lubricating compositions and functional fluids can contain one or more detergents or dispersants of the ash-producing or ashless type in addition to those that would be considered as being within the scope of the above-discussed components. The ash-producing detergents are exemplified by oil-soluble neutral and basic salts of alkali or alkaline earth metals with carboxylic acids or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricant compositions and functional fluids of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in many U.S. Pat. Nos. including 3,219,666; 4,234,435; and 4,938,881. These include the products formed by the reaction of a polyisobutenyl succinic anhydride with an amine such as a polyethylene amine.

(2) Reaction products of relatively high molecular weight aliphatic or alicyclic halides with amines, preferably oxyalkylene polyamines. These may be characterized as "amine dispersants" and examples thereof are described for example, in the following U.S. Pat. Nos. 3,275,554; 3,438,757; 3,454,555; and 3,565,804.

(3) Reaction products of alkyl phenols in which the alkyl group contains at least about 30 carbon atoms with aldehydes (especially formaldehyde) and amines (especially polyalkylene polyamines), which may be characterized as "Mannich dispersants." The materials described in the following U.S. Pat. Nos. are illustrative: 3,649,229; 3,697,574; 3,725,277; 3,725,480; 3,726,882; and 3,980,569.

(4) Products obtained by post-treating the amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos. 3,639,242; 3,649,229; 3,649,659; 3,658,836; 3,697,574; 3,702,757; 3,703,536; 3,704,308; and 3,708,422.

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Pat. Nos. 3,329,658; 3,449,250; 3,519,565; 3,666,730; 3,687,849; and 3,702,300.

The above-noted patents are incorporated by reference herein for their disclosures of ashless dispersants.

The inventive lubricating compositions and functional fluids can contain one or more extreme pressure, corrosion inhibitors and/or oxidation inhibitors. Extreme pressure agents and corrosion- and oxidation-inhibiting agents which may be included in the lubricants and functional fluids of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; metal thiocarbamates, such as zinc dioctyldithiocarbamate, and barium heptylphenyl dithiocarbamate; dithiocarbamate esters from the reaction product of dithiocarbamic acid and acrylic, methacrylic, maleic, fumaric or itaconic esters; dithiocarbamate containing amides prepared from dithiocarbamic acid and an acrylamide; alkylene-coupled dithiocarbamates; sulfur-coupled dithiocarbamates. Many of the above-mentioned extreme pressure agents and oxidation-inhibitors also serve as anti-wear agents.

Pour point depressants are a useful type of additive often included in the lubricating oils and functional fluids described herein. The use of such pour point depressants in oil-based compositions to improve low temperature properties of oil-based compositions is well known in the art. See, for example, page 8 of "Lubricant Additives" by C. V. Smallbeer and R. Kennedy Smith (Lezius Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. A specific pour point depressant that can be used is the product made by alkylating naphthalene with polychlorinated paraffin and $C_{16}$–$C_{18}$ alpha-olefin. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional antifoam compositions are described in "Foam Control Agents," by Henry T. Kerner (Noyes Data Corporation, 1976), pages 125–162.

The metal cotent for the Group 1A, IIA or IIB as discussed above under (C) *Second Phosphorus Compound* of this disclosure, and especially zinc is preferably in the range of 0.01–0.12 weight percent, more preferably in the range of 0.1–0.5 weight percent and i selected instances may range down to effectively zero weight percent for the inventive lubricant composition.

Each of the foregoing additives, when used, is used at a functionally effective amount to impart the desired properties to the lubricant or functional fluid. Thus, for example, if an additive is a dispersant, a functionally effective amount of this dispersant would be an amount sufficient to impart the desired dispersancy characteristics to the lubricant or functional fluid. Similarly, if the additive is an extreme-pressure agent, a functionally effective amount of the extreme-pressure agent would be a sufficient amount to improve the extreme-pressure characteristics of the lubricant or functional fluid. Generally, the concentration of each of these additives, when used, ranges from about 0.001% to about 20% by weight, and in one embodiment about 0.01% to about 10% by weight based on the total weight of the lubricant or functional fluid.

Components (AT) and (B), and optional components (C), (D), (E) and (F) of the inventive compositions as well as one of the other above-discussed additives or other additives known in the art can be added directly to the lubricant or functional fluid. In one embodiment, however, they are diluted with a substantially inert, normally liquid organic diluent such as mineral oil, naphtha, benzene, toluene or xylene to form an additive concentrate. These concentrates usually contain from about 1% to about 99% by weight, and in one embodiment about 10% to about 90% by weight of the inventive composition (that is, components (AT) and (B), and optional components (C), (D), (E) and (F) may contain, in addition, one or more other additives known in the art or described hereinabove. The remainder of the concentrate is the substantially inert normally liquid diluent.

It should be recognized that in treating the compounds represented by formula (A), (E) and (F) with the sulfur reducing agents not all polysulfides may need to be removed. For some specific purposes it may be preferable to leave some amounts of polysulfides in the products.

It should also be recognized that by reducing the polysulfide content of the disulfide compositions, other wear properties of these compounds is not affected.

To demonstrate the improvement of lubricating oils containing (AT), polysulfide reduced compositions correlating to (A), were mixed and run in the L-38 copper-lead bearing corrosion test. The lubricating composition had the formulation shown below in Table I.

TABLE I

Polysulfide Reduced Composition

| Component | Weight Percent |
|---|---|
| 100 N Base Oil | 70.04 |
| 150 N Base Oil | 12.36 |
| (AT) Example (A-1) treated with triphenyl phosphite (1:08 moles) | 0.16 |
| Example B-1 Dispersant | 4.03 |
| Example B-2 Dispersant | 1.37 |
| Alkylated Diphenyl Amine | 0.6 |
| Sulfurized Olefins | 0.3 |
| Sunflower Oil | 0.1 |
| Product of Example D-5 Calcium-Overbased | 0.48 |
| Product of Example D-1 Calcium Overbased | 0.22 |
| Product of Example D-1 Magnesium Overbased | 0.45 |
| Product Example D-4 | 0.20 |
| Product C-8 | 0.74 |
| Foam Inhibitor | 90 ppm |
| Diluent Oil | 0.25 |
| Olefin Copolymers Viscosity Modifier | .67 |
| Polymethacylate Viscosity Modifier | .18 |

The composition of Table 1 when tested under Test Method D5119 CRC-L38 Engine Evaluation of Engine Oils, gave a verified bearing weight loss of 26.2 mg in a 40-hour test. For the bearing weight loss a pass is less than 40 mg. In the same test in which (A) corresponding to Example A-I was used instead of (AT) a bearing weight loss of slightly greater than 40 resulted, a fail.

We claim:

1. A composition of matter, said composition comprising (AT) the reaction products formed by treating compounds represented by the formula (A) with a compound to reduce the bound sulfur content of (A):

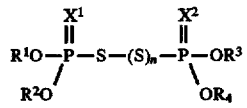

(A)

wherein in Formula (A), $R^1$, $R^2$, $R^3$ and $R^4$ are independently hydrocarbyl groups, $X^1$ and $X^2$ are independently O or S, and n is zero to 3; and wherein said reaction products have lower copper reactivity than (A); and (B) an acylated nitrogen-containing compound having a substituent of at least 10 aliphatic carbon atoms.

2. A composition according to claim 1, wherein said bound sulfur reducing compound is a phosphite.

3. A compound according to claim 2, wherein said phosphite is selected from triaryl phosphite or dialkyl hydrogen phosphite.

4. The composition according to claim 1, wherein said reaction products comprise (A) wherein n is O and 1, and sulfurized bound sulfur reducing compound.

5. The composition of claim 1 further comprising:

(C) a second phosphorus compound other than (A) said second phosphorus compound being a phosphorus acid, phosphorus acid ester, phosphorus acid salt, or derivative thereof.

6. The composition of claim 1 further comprising:

(D) an alkali or alkaline earth metal salt of an organic sulfur acid, carboxylic acid or phenol.

7. The composition of claim 1 further comprising:

(E) a compound represented by the formula $$R^1R^2N—C(X)S—(CR^3R^4)_aZ \quad \text{(E-I)}$$

wherein in Formula (E-1), $R^1$, $R^2$, $R^3$ and $R^4$ are independently hydrogen or hydrocarbyl groups, provided that at least one of $R^1$ and $R^2$ is a hydrocarbyl group; X is O or S; a is zero, 1 or 2; and Z is a hydrocarbyl group, a hetero group, a hydroxy hydrocarbyl group, an activating group, or a $-(S)_bC(X)NR^1R^2$ group wherein b is zero, 1 or 2; provide that when a is 2, Z is an activating group; and when a is zero, Z can be an ammonium, amine or metal cation.

8. The composition of claim 1 further comprising: an organic sulfide (F) represented by:

$$T^1-\overset{\overset{X^1}{\|}}{C}-S-(S)_n-\overset{\overset{X^2}{\|}}{C}-T^2 \qquad \text{(F-I)}$$

wherein in Formula (F-1), $T^1$ and $T^2$ are independently R, OR, SR or NRR wherein each R is independently a hydrocarbyl group, $X^1$ and $X^2$ are independently O or S, and n is zero to 3. In one embodiment, $X^1$ and $X^2$ are each S.

9. The composition of claim 8 wherein said organic sulfide is represented by:

$$RO-\overset{\overset{S}{\|}}{C}-S-(S)_n-\overset{\overset{S}{\|}}{C}-OR \qquad \text{(F-IV)}$$

wherein R and n are defined in claim 8.

10. The composition of claim 7 wherein (E) is a compound represented by the formula $$R^1R^2N-\overset{\overset{X}{\|}}{C}S-\overset{\overset{X}{\|}}{S}C-NR^1R^2 \qquad \text{(E-VII)}$$

wherein in Formula (E-VII), $R^1$ and $R^2$ are independently hydrocarbyl groups, and X is O or S.

11.The composition of claim 1 wherein in Formula (A), $X^1$and $X^2$ are each S, and n is 1.

12. The composition of claim 1 wherein in Formula (A), $R^1$, $R^2$, $R^3$ and $R^4$ are independently hydrocarbyl groups of 1 to about 50 carbon atoms.

13. The composition of claim 1 wherein in Formula (A), $R^1$, $R^2$, $R^3$ and $R^4$ are independently isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl or alkylnaphthylalkyl.

14. The composition of claim 1 wherein said acylated nitrogen-containing compound (B) is derived from a carboxylic acylating agent and at least one amino compound containing at least one —NH— group, said acylating agent being linked to said amino compound through an imido, amido, amidine or salt linkage.

15. The composition of claim 14 wherein said amino compound is an alkylene polyamine represented by the formula:

$$R-\underset{\underset{R}{|}}{N}(-U-\underset{\underset{R}{|}}{N}-)_n-R \qquad \text{(B-I)}$$

wherein in Formula (B-1): U is an alkylene group of from about 1 to about 18 carbon atoms; each R is independently a hydrogen atom, or a hydrocarbyl group or a hydroxy-substituted hydrocarbyl group containing up to about 30 carbon atoms, with the proviso that at least one R is a hydrogen atom; and n is 1 to about 10.

16. The composition of claim 14 wherein said amino compound is an alkylene polyamine of 2 to about 8 amino groups.

17. The composition of claim 14 wherein said amino compound is an ethylene, propylene or trimethylene polyamine, or mixture of two or more thereof.

18. The composition of claim 14 wherein said carboxylic acylating agent is a mono- or polycarboxylic acid or anhydride, or reactant equivalent thereof, containing an aliphatic hydrocarbyl substituent of at least about 30 carbon atoms.

19. The composition of claim 12 wherein said hydrocarbyl substituent is derived from a homo- or interpolymer of a $C_{2-10}$ 1-mono olefin or mixture thereof.

20. The composition of claim 1 wherein (B) is an alkenyl succinimide containing at least about 30 aliphatic carbon atoms in the alkenyl group.

21. The composition of claim 1 wherein (B) is a polyisobutenyl succinimide containing at least about 50 aliphatic carbon atoms in the polyisobutenyl group.

22. The composition of claim 5 wherein (C) is a phosphoric acid, phosphonic acid, phosphinic acid, monothiophosphoric acid, dithiophosphoric acid, thiophosphinic acid or thiophosphonic acid, ester, salt or derivative thereof.

23. The composition of claim 5 wherein (C) is a phosphorus acid ester derived from a phosphorus acid or anhydride and an alcohol of 1 to about 50 carbon atoms.

24. The composition of claim 5 wherein (C) is a phosphite, a monothiophosphate, or a dithiophosphate.

25. The composition of claim 5 wherein (C) is a phosphorus containing amide or a phosphorus-containing carboxylic ester.

26. The composition of claim 5 wherein (C) is a compound represented by the formula $$\begin{array}{l} R^1-(O)_a \diagdown \\ R^2-(O)_b-P=X \\ R^3-(O)_c \diagup \end{array} \qquad \text{(C-I)}$$

wherein in Formula (C-1), $R^1$, $R^2$ and $R^3$ are independently hydrogen or hydrocarbyl groups, X is O or S, and a, b and c are independently zero or 1.

27. The composition of claim 5 wherein (C) is a compound represented by the formula $$\begin{array}{l} R^1-(O)_a \diagdown \\ R^2-(O)_b-P \\ R^3-(O)_c \diagup \end{array} \qquad \text{(C-II)}$$

wherein in Formula (C-II), $R^1$, $R^2$ and $R^3$ are independently hydrogen or hydrocarbyl groups, and a, b and c are independently zero or 1.

28. The composition of claim 5 wherein (C) is a compound represented by the formula $$\begin{array}{l} R^1(X^1)_a \diagdown \overset{\overset{X^3}{\|}}{P}-X^4R^3 \\ R^2(X^2)_b \diagup \end{array} \qquad \text{(C-III)}$$

wherein in Formula (C-III): $X^1$, $X^2$ and $X^3$ and $X^4$ are independently O or S, and $X^1$ and $X^2$ can be $NR^4$; and b are independently zero or 1; and $R^1$, $R^2$, $R^3$and $R^4$ are independently hydrocarbyl groups, and $R^3$ and $R^4$ can be hydrogen; or a metal, amine or ammonium salt of said compound represented by Formula (C-III).

29. The composition of claim 28 wherein in Formula (C-III), $X^1$ and $X^2$ are oxygen, $X^3$ and $X^4$ are sulfur, and $R^1$ and $R^2$ are independently hydrocarbyl groups of 1 to about 30 carbon atoms.

30. The composition of claim 28 wherein said compound represented by Formula (C-III) is a metal salt, said metal being a Group IA, IIA or IIB metal, aluminum, tin iron, cobalt, lead, molybdenum, manganese, nickel, antimony, bismuth, or a mixture of two or more thereof.

31. The composition of claim 28 wherein said compound represented by Formula (C-III) is a metal salt, said metal being zinc.

32. The composition of claim 6 wherein (D) is a neutral or basic alkali or alkaline earth metal sulfonate.

33. The composition of claim 6 wherein (D) is a neutral or basic alkali or alkaline earth metal carboxylate or phenate.

34. The composition of claim 6 wherein (D) is an alkali or alkaline earth metal salt of a sulfonic acid represented by the formulae $$R^1(SO_3H)_r \qquad \text{(D-I)}$$

or $$(R^2)_xT(SO_3H)_y \qquad \text{(D-II)}$$

wherein in Formulae (D-I) and (D-II), $R^1$ and $R^2$ are each independently aliphatic groups, $R^1$ contains at least about 15 carbon atoms, the sum of the number of carbon atoms in $R^2$ and T is at least about 15, T is an aromatic hydrocarbon nucleus, and x is a number of 1 to 3, r and y are numbers of 1 to 4.

35. The composition of claim 6 wherein said sulfur acid is an alkylated benzene sulfonic acid or alkylated naphthalene sulfonic acid.

36. The composition of claim 6 wherein said alkali or alkaline earth metal is calcium, sodium, magnesium or barium.

37. The composition of claim 7 wherein (E) is a compound represented by the formula $$R^1R^2N-\overset{\overset{\displaystyle S}{\|}}{C}-S-CH_2CH_2-\overset{\overset{\displaystyle O}{\|}}{C}-OR^5 \qquad \text{(E-V)}$$

wherein in Formula (E-V), $R^1$, $R^2$ and $R^5$ are independently hydrocarbyl groups.

38. The composition of claim 7 wherein (E) is a compound represented by the formula $$(C_4H_9)_2N-\overset{\overset{\displaystyle S}{\|}}{C}-S-CH_2CH_2-\overset{\overset{\displaystyle O}{\|}}{C}-OCH_3 \qquad \text{(E-VI)}$$

39. The composition of claims 8, 9 or 10, wherein said (F-I) and (F-IV) and (E-VII) have their sulfur content reduced by reaction with said bound sulfur reducing compound, and wherein the sulfur reduced (F-I) and (F-IV) and (E-VII) have less copper reactivity than the non-sulfur reduced (F-I) and (F-IV) and (E-VII) of claims 8, 9, or 10.

40. The composition of claim 1 further comprising a corrosion-inhibiting agent, detergent, dispersant, antioxidant, viscosity improving agent, antiwear agent, extreme-pressure agent, pour-point depressant, friction-modifier, fluidity-modifier, anti-foam agent, or mixture of two or more thereof.

41. The composition of claim 5, said composition further comprising (D), an alkali or alkaline earth metal salt of an organic sulfur acid, carboxylic acid or phenol.

42. The composition of claim 5, said composition further comprising (E-1) a compound represented by the formula as recited in claim 7.

43. The composition of claim 5, said composition further comprising an organic sulfide (F-I) as recited in claim 8.

44. The composition of claim 5, said composition further comprising an organic sulfide (F-IV) as recited in claim 9.

45. The composition of claim 5, said composition further comprising said reaction products of claim 10.

46. A lubricating composition comprising the composition of claim 1 in an oil of lubricating viscosity.

47. A lubricating composition comprising the composition of claim 5 in an oil of lubricating viscosity.

* * * * *